US006490869B1

(12) United States Patent
Uetsuji et al.

(10) Patent No.: US 6,490,869 B1
(45) Date of Patent: Dec. 10, 2002

(54) MANIFOLD WITH BUILT-IN THERMOELECTRIC MODULE

(75) Inventors: Toshio Uetsuji, Hirakata (JP); Syouhei Inamori, Yasu-gun (JP); Osao Kido, Soraku-gun (JP); Kenichi Morishita, Nishinomiya (JP); Masatsugu Fujimoto, Sakai (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/936,844

(22) PCT Filed: Mar. 17, 2000

(86) PCT No.: PCT/JP00/01634

§ 371 (c)(1),
(2), (4) Date: Nov. 20, 2001

(87) PCT Pub. No.: WO00/57115

PCT Pub. Date: Sep. 28, 2000

(30) Foreign Application Priority Data

Mar. 19, 1999 (JP) ..... 11-076939

(51) Int. Cl.[7] ..... F25B 21/02
(52) U.S. Cl. ..... 62/3.3; 62/3.7
(58) Field of Search ..... 62/3.1, 3.2, 3.3, 62/3.7

(56) References Cited

U.S. PATENT DOCUMENTS 6,086,831 A * 7/2000 Harness et al. ..... 422/199

FOREIGN PATENT DOCUMENTS

| | | |
|---|---|---|
| JP | 50-38804 | 4/1975 |
| JP | 50-152204 | 12/1975 |
| JP | 64-59877 | 3/1989 |
| JP | 1-118193 | 8/1989 |
| JP | 8-236820 | 9/1996 |
| JP | 10-246531 | 9/1998 |
| WO | 92/13243 | 8/1992 |
| WO | 95/31688 | 11/1995 |
| WO | 99/18399 | 4/1999 |

* cited by examiner

*Primary Examiner*—Henry Bennett
*Assistant Examiner*—Melvin Jones
(74) *Attorney, Agent, or Firm*—Wenderoth, Lind & Ponack, L.L.P.

(57) ABSTRACT

A thermoelectric module (7) having exothermic and endothermic surfaces, which are heated and cooled, respectively, when an electric current is supplied thereto is built in a manifold body (17), and a cavity (10*c*, 10*d*, 20*d*) is defined therein for entry of a fluid medium in cooperation with at least one of the exothermic and endothermic surfaces, together with a hollow (10*a*, 10*b*, 20*a*, 20*b*) that extends from an outside to the cavity. A stirring member (5) having a stirring portion (15) integrated together with a rotor (16) within the manifold body (17) for stirring the fluid medium within the cavity is disposed within the manifold body, so that a motor can be formed by the rotor (16) and a stator (8). In this structure, the stirring member (5) is rotated by supplying electric power to the stator (8), to allow the fluid medium to reach the cavity (10*c*, 10*d*) through the interior of the rotor (16).

14 Claims, 19 Drawing Sheets

MANIFOLD WITH BUILT-IN THERMOELECTRIC MODULE

FIELD OF THE INVENTION

The present invention relates to a manifold having built therein a thermoelectric module of a type having a Peltier effect.

BACKGROUND ART

In recent years, depletion of the ozone layer in contact with fluorinated hydrocarbon gas has come to be a global problem and immediate development of refrigerating apparatuses that do not use fluorinated hydrocarbons is desired. As one of the refrigerating apparatuses that do not use fluorinated hydrocarbons the refrigerating apparatus utilizing a thermoelectric module has now come to be spotlighted.

The thermoelectric module includes a Peltier module or a component known as a thermoelectric module and having two heat transfer surfaces which are heated and cooled, respectively, when an electric current is applied thereto. In other words, in the thermoelectric module, one of the heat transfer surfaces acts as an exothermic surface whereas the other of the heat transfer surfaces acts as an endothermic surface.

The refrigerating apparatus utilizing the thermoelectric module is disclosed in, for example, the published International Application WO92/13243, in which the thermoelectric module is built in a manifold having two cavities defined on respective sides of the thermoelectric module. One of the cavities facing the exothermic surface of the manifold is coupled with a closed circuit comprised of a heat exchanger and a pump whereas the other of the cavities facing the endothermic surface is similarly coupled with a closed circuit comprised of a heat exchanger and a pump. In this way, a circulating circuit including the heat transfer surface on an endothermic side of the thermoelectric module and a circulating circuit including the heat transfer surface on a cooling side are defined, and a heat transfer medium including water as a principal component is circulated therein. A desired refrigeration can be accomplished by means of the heat exchanger installed on one of these two circulating circuits and on the cooling side.

Although the invention disclosed in WO92/13243 referred to above is a technology in which the thermoelectric module is utilized to achieve a practical refrigeration, it merely discloses a basic structure of the refrigerating apparatus and involves a number of problems to be solved in order for that invention to be practically applicable to a refrigerator or the like.

In other words, the refrigerating apparatus utilizing the thermoelectric module has a lower refrigerating efficiency than that exhibited by the traditional refrigerating apparatus operating with a fluorinated hydrocarbon gas.

The technology disclosed in WO92/13243 involves a problem of how the contact between the heat transfer medium and the heat transfer surfaces of the thermoelectric module should be smoothened to increase the refrigerating efficiency. As an improving means for enhancing a heat exchange between the thermoelectric module and the heat transfer medium, the invention disclosed in the published International Application WO95/31688 (PCT/AU95/00271) is known, in which a stirrer blade is disposed within the cavity of the manifold to enhance contact between the heat transfer medium and the heat transfer surfaces of the thermoelectric module and which is expected to exhibit a high heat transfer efficiency as compared with the traditional one.

However, WO95/31688 has failed to disclose a specific means for driving the stirrer blade within the cavity. In otherwords, although the use of the stirrer blade within the cavity is effective to alleviate the previously discussed problem to a certain extent, no specific means for driving the stirrer blade within the cavity is disclosed.

Also, in order for the stirrer blade within the cavity to be driven, the use of a bearing seal for a rotary shaft is necessitated to countermeasure against leakage of the heat transfer medium. In addition, in order for the heat transfer medium to be supplied into the narrow cavity, complicated flow passages need be formed within the cavity, resulting in a problem associated with a relatively large loss of pressure.

The present invention has therefore been developed with the foregoing problems taken into consideration and is intended to provide a manifold in which a thermoelectric module having a heat exchange efficiency increased by the provision of a stirrer member for stirring a fluid within the cavity is incorporated.

Another object of the present invention is to provide a manifold with the thermoelectric module built therein, wherein the heat exchange efficiency is increased by enhancing contact between the heat transfer medium and the heat transfer surfaces of the thermoelectric module and which has a high reliability with a minimized loss of pressure.

SUMMARY OF THE INVENTION

In order to accomplish the foregoing objects, the manifold having the thermoelectric module built therein in accordance with the present invention is characterized by comprising a thermoelectric module having exothermic and endothermic (heat transfer) surfaces, which are heated and cooled, respectively, when an electric current is supplied thereto; a manifold body accommodating therein the thermoelectric module, said manifold having a cavity defined therein for entry of a fluid medium in cooperation with at least one of the exothermic and endothermic surfaces and having a hollow defined therein so as to extend from an outside to the cavity; a stirring member disposed within the manifold body and having a stirring portion integrated together with a rotor for stirring the fluid medium within the cavity; and a stator mounted externally on the manifold body; said rotor and said stator cooperating with each other to form a motor, said stirring member when electric power is supplied to the stator rotating within the cavity to allow the fluid medium to flow past an interior of the rotor towards the cavity.

In this structure, since the stirring member rotates within the cavity when electric power is supplied to the external stator, the opportunity of the fluid medium contacting the thermoelectric module increases to thereby increase the heat exchange efficiency. Also, since no shaft seal is needed, leakage of the fluid medium is small, resulting in increase in reliability. In addition, since the fluid medium flows through the interior of the rotor to reach the cavity, a fluid passage is straight and a loss of pressure is small.

If an opening is provided at a center portion of the rotor and the fluid medium flows past such opening, the flow of the fluid medium will be rectilinear and the loss of pressure can further be reduced.

Also, the manifold having the thermoelectric module built therein in accordance with the present invention is characterized by comprising a thermoelectric module having exothermic and endothermic surfaces, which are heated and cooled, respectively, when an electric current is supplied thereto; a manifold body accommodating therein the thermoelectric module, said manifold body having a cavity defined therein for entry of a fluid medium in cooperation with at least one of the exothermic and endothermic surfaces and having a hollow defined therein so as to extend from an outside to the cavity; and a stirring member disposed within the manifold body for stirring the fluid medium within the cavity, said stirring member having a throughhole defined therein, said through hole being provided with a blade member, the fluid medium being allowed to flow through the throughhole towards the cavity.

In this structure, since the fluid medium reaches the cavity through the throughhole defined in the stirring member, the flow passage for the fluid medium is rectilinear and the loss of pressure is small. Also, since the vanes disposed in the throughhole exhibit a function similar to vanes of an axial flow pump to urge the fluid medium to thereby vigorously contact the thermoelectric module, the heat exchange efficiency between the thermoelectric module and the fluid medium increases.

In addition, if the stirring member is rotatable about an axis intersecting any one of the endothermic and exothermic surfaces, the fluid medium flows in a direction intersecting the endothermic or exothermic surface and, therefore, the opportunity of the fluid medium to contact the endothermic or exothermic surface increases to thereby increase the heat exchange efficiency.

In the event that the stirring member has a center portion having a throughhole defined therein and in that a bearing member is supported within the through hole by means of ribs and that the bearing member is inserted in a support shaft fixed relative to the manifold body to thereby support the stirring member for rotation, the fluid medium having flown through the throughhole is directly introduced into the cavity and then vigorously contacts the thermoelectric module, resulting in increase of the heat exchange efficiency.

Where the ribs for supporting the bearing member are provided with respective inclined surfaces, the fluid medium can be urged towards the cavity as the ribs rotate. In other words, since the ribs exhibit a function similar to an axial flow pump to pump the fluid medium towards the cavity, the fluid medium can vigorously contact the thermoelectric module, resulting in increase of the heat exchange efficiency.

Also, where the bearing member has a hole or a tapered portion defined therein and having a diameter enlarged outwardly at one end face thereof, the fluid medium enters inside the bearing member to thereby lubricate the bearings and, therefore, rotation of the stirring member can become smooth.

Cavities may be defined respectively between the thermoelectric module and the endothermic surface and between the thermoelectric module and the exothermic surface, with the stirring member provided in each of the cavities, at least one of the stirring members being provided with magnets, so that rotation of one of the stirring members can be transmitted to the other of the stirring members by means of a magnetic force. This structure is effective in that since rotation of only one of the stirring members is sufficient to simultaneously rotate the stirring members on the heating and cooling sides, respectively, the number of component parts can be reduced to make it possible to manufacture the manifold in a compact size. Also, since driving power can be transmitted between the stirring members in a non-contact manner, it is possible to secure independence of those cavities with no fear of the heat transfer medium on the heating side and the heat transfer medium on the cooling size being mixed together.

If the manifold body covers only one of the heat transfer surfaces of the thermoelectric module and the other of the heat transfer surfaces of the thermoelectric module is held in abutment with a heat conductive plate, an object to be cooled can be directly cooled by the heat conductive plate.

DETAILED DESCRIPTION OF THE INVENTION

Figure 1:
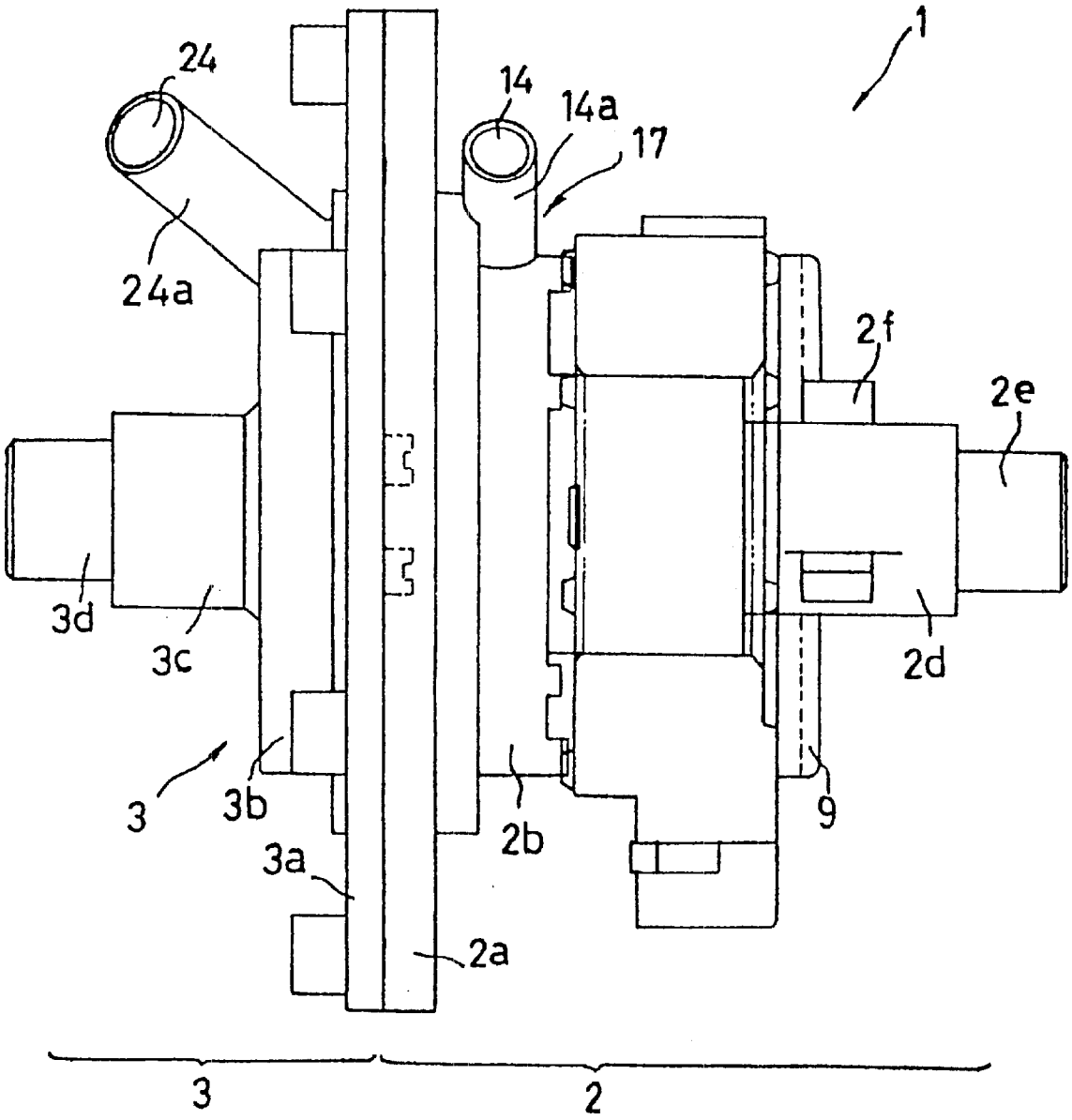
FIG. 1 is a front elevational view of a manifold having a thermoelectric module built therein according to a first embodiment of the present invention.

Hereinafter, embodiments of the present invention will be described with reference to the accompanying drawings.

(Embodiment 1)

Referring to FIGS. 1 to 4, reference numeral 1 represents a manifold having a thermoelectric module built therein according to the first embodiment of the present invention. The manifold 1 having the thermoelectric module built therein includes the thermoelectric module 7 disposed in a manifold body 17 and having a stator 8 mounted externally on the manifold body 17. Mounting of the stator 8 is accomplished by the use of a fixing ring 9. The manifold body 17 includes a heating side manifold 2 and a cooling side manifold 3, and a heating side stirring member 5 and a cooling side stirring member 6 are disposed respectively in the heating side manifold 2 and the cooling side manifold 3. In the manifold having the thermoelectric module according to the illustrated embodiment, the heating side stirring member 5 is integrally fixed with a rotor 16, and the stator 8 mounted externally on the manifold body 17 and the rotor 16 disposed in the manifold body 17 altogether constitute a motor.

The details will now be described.

The heating side manifold 2 is made of a polypropylene resin or a polyethylene resin by the use of an injection molding technique.

The heating side manifold 2 has an outer appearance having a discshaped flange 2*a*, bosses 2*b* and 2*c* that are continued therefrom, and tubular portions 2*d* and 2*e* that are in turn continued therefrom. In other words, the heating side manifold 2 includes the flange 2*a* and a large diameter boss 2*b* continued therefrom. The large diameter boss 2*b* is in turn continued from a small diameter boss 2*c* having a smaller diameter than the large diameter boss 2*b*. The small diameter boss has one end reduced in diameter to define a large diameter tubular portion 2*d* having one end reduced in diameter to define a small diameter tubular portion 2*e*.

Figure 2:
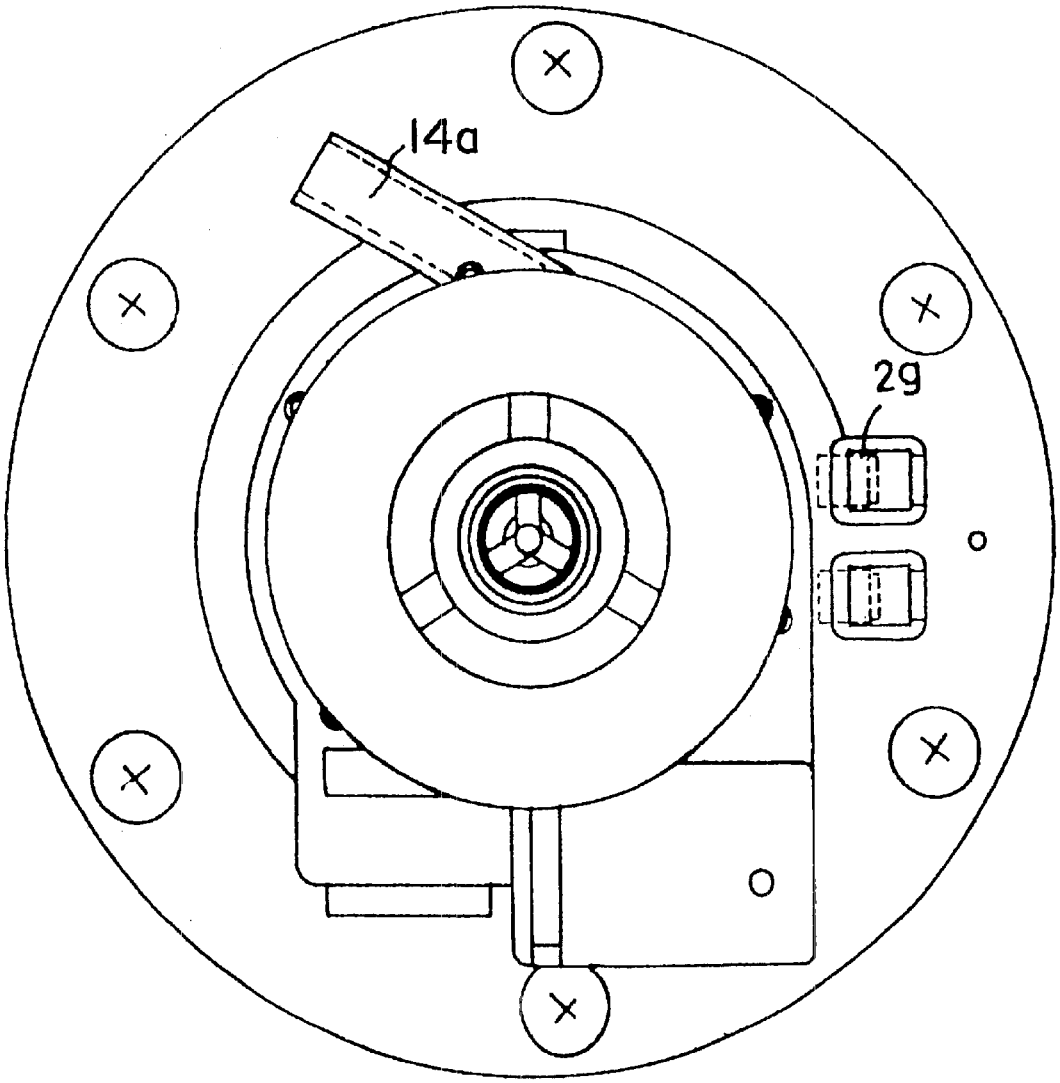
FIG. 2 is a right hand side view of the manifold shown in FIG. 1.

The large diameter boss 2*b*, the small diameter boss 2*c*, the large diameter tubular portion 2*d* and the small diameter tubular portion 2*e* are all coaxial with each other, but the flange 2*a* is somewhat eccentrically disposed as clearly shown in FIG. 2. The reason that only the flange 2*a* is eccentric is because a space for installation of a terminal 2*g* (FIG. 2) through which the thermoelectric module is supplied an electric power need be secured.

In the heating side manifold 2 employed in the illustrated embodiment, three projections 2*f* are provided on an outer periphery of the large diameter tubular portion 2*d*. These three projections 2*f* are disposed on the same circumference and spaced an equal distance from each other.

The interior of the heating side manifold 2 is a hollow 10 that extends from the small diameter tubular portion 2*e* towards the flange 2*a*. The hollow 10 in the interior of the heating side manifold 2 has a round sectional shape in all aspects. The hollow 10 has an outer diameter corresponding to that of the bosses 2*b* and 2*c* and the tubular portions 2*d* and 2*e* and progressively increases from the small diameter tubular portion 2*e* towards the flange 2*a*.

In other words, the hollow 10 in the interior of the heating side manifold 2 is divided into four portions which are, in the order from the small diameter tubular portion 2*e*, a first hollow portion 10*a*, a second hollow portion 10*b*, a first cavity 10*c* and a second cavity 10*d*, the second cavity 10*d* opening towards the flange 2*a*. In the illustrated embodiment, an opening 13 adjacent the small diameter tubular portion 2*e* functions as a heat transfer medium inlet.

An open end of the second cavity 10*d* is bordered in two stages. A first stage 10*e* of the opening of the second cavity 10*d* is provided with an annular groove 2*h*. This groove 2*h* has an O-ring 31 inserted therein.

The second stage 10*f* of the opening of the second cavity 10*d* has an inner diameter substantially equal to the diameter of the outer periphery of the thermoelectric module 7.

Also, in the heating side manifold 2, an annular groove 2*i* is formed in a flange surface of the flange 2*a*. This groove 2*i* has an O-ring 30 inserted therein.

A shaft fixture 11 is provided within the interior of the heating side manifold 2. This shaft fixture 11 includes, as shown in FIGS. 4, 5A, 8A to 8D and 10A, a cylindrical shaft support 11*a*. This shaft support 11*a* is supported coaxially within the second hollow portion 10*b* by means of ribs 11*b*. More specifically, three ribs 11*b* are radially provided within the large diameter tubular portion 2*d* and, thus, the second hollow portion 10*b*. These ribs 11*b* are integrated at their one end with a side surface of the shaft support 11*a* and the shaft support 11*a* is consequently supported centrally within the second hollow portion 10*b*. An axial position of the shaft support 11*a* lies at a location bridging between the second hollow portion 10*b* and the first cavity 10*c*.

A support shaft 12 made of stainless steel or the like is integrally fixed on the shaft support 11*a* of the shaft fixture 11. Accordingly, the support shaft 12 is fixedly supported in coaxial relation with the second hollow portion 10*b*.

The large diameter boss 2*b* is provided with a pipe-like heat transfer medium outlet 14 communicated from the interior (the second cavity 10*d*) towards the outside. A pipe-like portion 14*a* of the heat transfer medium outlet 14 lies, as shown in FIGS. 1 and 2, on the same plane as the second cavity 10*d* and extends in a direction tangential to the second cavity 10*d*.

The heating side stirring member 5 includes stirring blade (stirring portion) 15 integrated together with the rotor 16 of the motor. In other words, the stirring blade 15 of the heating side stirring member 5 is made of a resin by the use of an injection molding technique and includes a boss portion 15*a* and a disc portion 15*b*, four vanes 15*c* being provided on one of opposite surfaces of the disc portion 15*b*.

Figure 11:
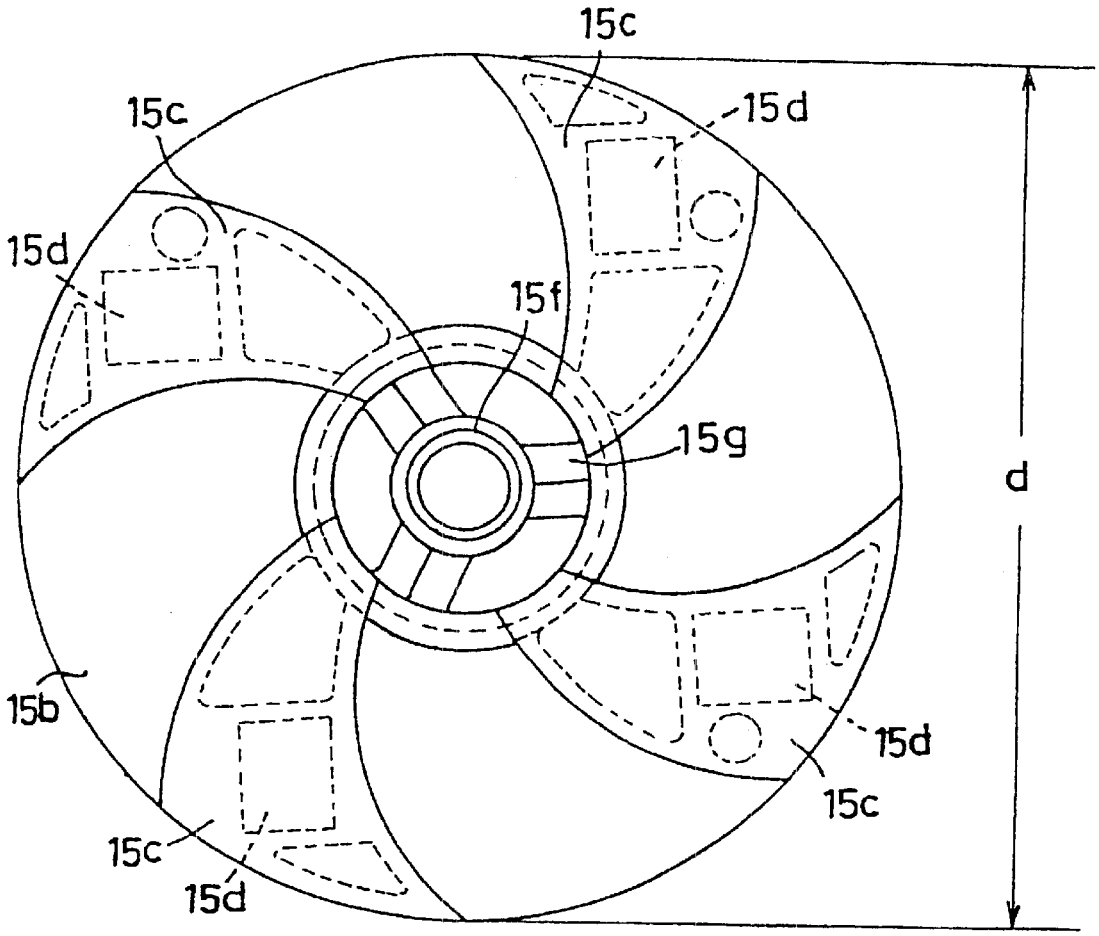
FIG. 11 is a front elevational view of the stirring member incorporated in the manifold shown in FIG. 1.

The vanes 15*c* are slender at a center portion when viewed from the front (FIG. 11) and have a width progressively increasing towards the outer circumstance and are of a somewhat twisted shape.

The outer diameter d of the vanes 15*c* is 94% or less of the inner diameter D of the second cavity 10*d* of the previously described heating side manifold 2. In other words, when the heating side stirring member 5 is mounted in the heating side manifold 2, a clearance of a size equal to 3% or more of the inner diameter of the second cavity 10*d* can be formed between the vanes 15*c* and the inner peripheral surface of the second cavity 10*d*.

It is to be noted that the shape of the vanes of the heating side stirring member 5 may not be limited to that shown in connection with the illustrated embodiment, but may be similar to that of a windmill or propeller, or of a design in which plates are secured upright on the disc so as to lie perpendicular thereto.

As a structural feature peculiar to the illustrated embodiment, a cubic permanent magnet 15*d* is secured within each of the vanes 15*c*.

Figure 12:
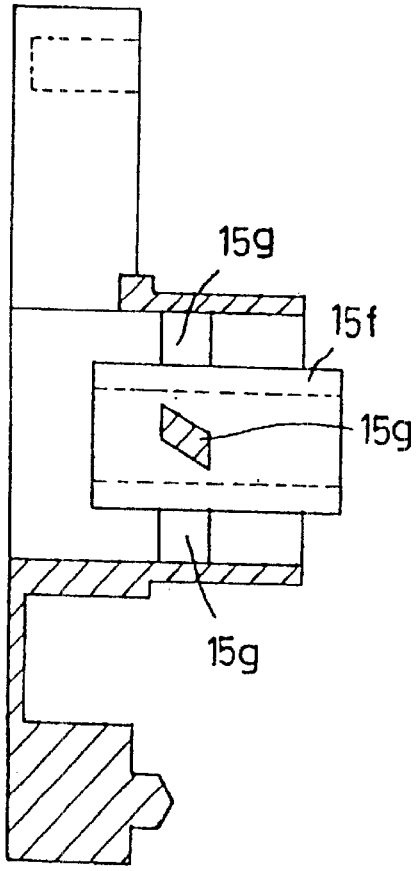
FIG. 12 is a sectional view of the stirring member shown in FIG. 11.

On the other hand, the boss portion 15*a* is a cylindrical hollow bodyhaving an outer diameter which is approximately one third to one fourth of the disc portion 15*b*. At a center of the boss portion 15*a*, there is provided a tubular bearing member 15*f* as shown in FIG. 12. In other words, the bearing member 15*f* is retained at a location aligned with a center axis of the boss portion 15*a* by means of three ribs 15*g* provided inside the boss portion 15*a*.

In the illustrated embodiment, the ribs 15*g* are in the form of a plate and have their respective planes inclined relative to the axis as shown in FIG. 12. In this illustrated embodiment, the ribs 15*g* serve, in addition to support for the bearing member 15*f*, as vanes.

As will be described later, the heat transfer medium flows through the boss portion 15*a*, but since in the illustrated embodiment the ribs 15*g* are inclined relative to the axis, the heat transfer medium can be convolved.

Specifically, the rotor 16 of the motor is a cylindrical permanent magnet. This rotor 16 is provided with a flange 16*b*. The outer diameter of a magnet portion of the rotor 16 is about half the stirring blade (stirring portion) 15. Also, the rotor 16 has a center portion formed with a hole 16*a* of a size equal to the outer diameter of the previously described boss portion 15*a*.

The rotor 16 has the center hole 16*a* into which the boss portion 15*a* of the stirring blade (stirring portion) 15 is inserted and also has the flange 16*b* secured to the disc portion 15*b* by means of screws. In other words, the rotor 16 is integrally coupled with the stirring blade (stirring portion) 15 by means of screws.

The relationship between the heating side manifold 2 and the heating side stirring member 5 will now be described. The heating side stirring member is disposed within the first and second cavities 10*c* and 10*d* of the heating side manifold 2. More specifically, the disc portion 15*b* and the vanes 15*c* of the heating side stirring member 5 are positioned within the second cavity 10*d* while the rotor 16 is disposed within the first cavity 10*c*. As discussed above, the clearance of a size equal to 3% or more of the inner diameter of the second cavity 10*d* is defined between the vanes 15*c* and the inner peripheral surface of the second cavity 10*d*.

Figure 5A:
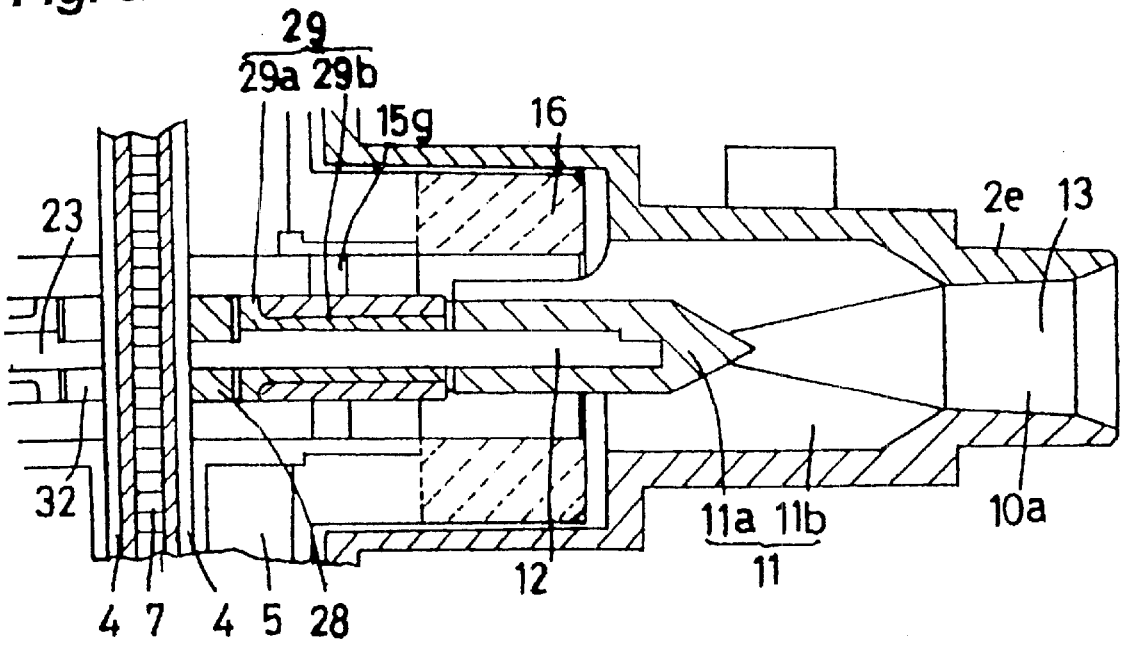
FIG. 5A is an enlarged sectional view, showing a support shaft and its vicinity shown in FIG. 4.

As shown in FIG. 5A, a bushing 29 is interposed in the bearing member 15*f* of the heating side stirring member 5 and the support shaft 12 of the heating side manifold 2 is inserted therethrough. The bushing 29 employed in the illustrated embodiment is of a design including a collar 29*a* and a body portion 29*b*, the body portion 29*b* having a length approximately equal to the bearing member 15*f*.

The support shaft 12 is, as hereinbefore described, passed through the bearing member 15*f* of the heating side stirring member 5. In this condition, a stop member 28 is fitted to a tip of the support shaft 12. This stop member 28 is crimped to the support shaft 12 to thereby avoid separation thereof from the support shaft 12. Accordingly, a front end face of the bearing member 15*f* is held in contact with the stop member 28 through the collar 29*a*, and a force urging the heating side stirring member 5 towards the thermoelectric module 7 is supported by the stop member 28. A rear end face of the bearing member 15*f* is held in abutment with a front end of the shaft support 11*a*. Accordingly, the bearing member 15*f* of the heating side stirring member 5 is sandwiched between the shaft support 11*a* and the stop member 28. For this reason, in the illustrated embodiment, the heating side stirring member 5 is rotatable about an axis perpendicular to heat transfer surfaces of the thermoelectric module 7, but is fixed to the heating side manifold 2 with respect to an axial direction thereof. In the condition in which the heating side stirring member 5 is mounted on the heating side manifold 2, the stop member 28 is positioned a slight distance inwardly of a flange surface of the flange 2*a* of the heating side manifold 2. More specifically, the tip of the stop member 28 is positioned at a location closer to the heat transfer medium inlet 13 than to the first stage 10*e* of the opening of the heating side manifold 2.

Figure 5B:
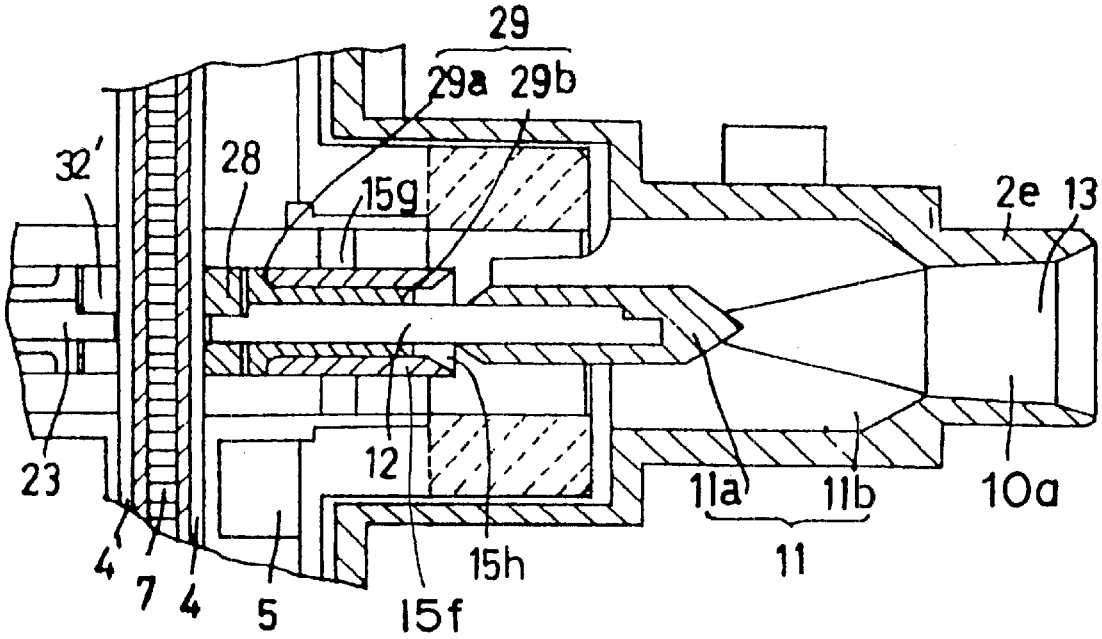
FIG. 5B is an enlarged sectional view, showing a modification of FIG. 5A.

It is to be noted that in the illustrated embodiment, as shown in FIG. 5A, the body portion 29*b* of the bushing 29 has a length approximately equal to the bearing member 15*f* and the bushing 29 is inserted over the entire length of the bearing member 15*f*. However, as shown in FIG. 5B, the design may be recommended in which the body portion 29*b* of the bushing 29 may have a length shorter than the bearing member 15*f* and a rear end of the bearing member 15*f* may be provided with a tapered portion 15*h* to enlarge the diameter of that end of the hole. This design is intended so that the heat transfer medium can be used as a lubricant. In other words, as will be described later, a center portion of the heating side stirring member 5 functions as a passage of the flow of the heat transfer medium and, when in use, the bearing member 15*f* is exposed to the flow of the heat transfer medium. In view of this, as shown in FIG. 5B, the provision of the tapered portion 15*h* at the rear end of the bearing member 15*f* is effective for the heat transfer medium to be collected by the tapered portion 15*h* in readiness for introduction into the bearing member 15*f*. As a result thereof, the heat transfer medium functions as a lubricant so that the frictional resistance brought about at the time of rotation of the heating side stirring member 5 can be reduced.

Although the structure shown in FIG. 5B is such that the tapered portion 15*h* is provided at the rear end of the bearing member 15*f* to flare the end of the hole in an upstream direction with respect to the direction of flow of the fluid, similar effects can be appreciated to a certain extent even when a hole having an increasing diameter (a hole of an inner diameter greater than the inner diameter of the bearing member 15*f*) is merely employed. Where the enlarged hole is employed without being tapered, a rear end portion of the hole in the bearing member 15*f* will represent a stepped shape.

In the condition in which the heating side manifold 2 and the heating side stirring member 5 are assembled together, the heat transfer medium inlet 13 of the heating side manifold 2 and a front surface side of the disc portion 15*b* of the heating side stirring member 5 are communicated with each other. In other words, the heat transfer medium inlet 13 is communicated with the first hollow portion 10*a* which is in turn communicated with the opening in the boss portion 15*a* of the heating side stirring member 5. The boss portion 15*a* is tubular and has its tip portion opening towards the front surface of the disc portion 15*b* of the heating side stirring member 5. Accordingly, the heat transfer medium inlet 13 of the heating side manifold 2 and the front surface side of the disc portion 15*b* of the heating side stirring member 5 are communicated with each other.

In the manifold having the thermoelectric module built therein according to the illustrated embodiment, a series of passages communicated in the manner described above provides a flow path for the heat transfer medium. In otherwords, a hole 16*a* is provided on a side adjacent a radial center of the rotor 16 and this hole 16*a* itself, or the hole in the boss portion 15*a* inserted into the hole 16*a*, acts as a portion of the heat transfer medium inlet passage for introducing the fluid into the second cavity 10*d*.

Next, the structure of a cooling side manifold 3 and that of a cooling side stirring member 6 will be described. The cooling side manifold 3 is generally symmetrical to the previously described heating side manifold 2 and includes a disc-shaped flange 3*a*. In this cooling side manifold 3, a boss portion 3*b* is one-stepped. A rear end portion of the boss 3*b* is connected to tubular portions 3*c* and 3*d*. The large diameter tubular portion 3*d* of the cooling side manifold 3 has an outer periphery in the form of a smooth cylindrical surface with no projection formed thereon.

The interior of the cooling side manifold 3 is defined by a hollow 20 as is the case with the heating side manifold 2, which hollow 20 is communicated from the small diameter tubular portion 3*d* towards the flange 3*a*. The hollow 20 has an inner diameter divided into three stages which define, in the order from the small diameter tubular portion 3*d*, a first hollow portion 20*a*, a second hollow portion 20*b* and a cavity 20*d*, said cavity 20*d* opening towards the flange 3*a*. An opening 21 adjacent the small diameter tubular portion 3*d* functions as a heat transfer medium inlet.

Within the cooling side manifold 3, there is provided a shaft fixture 22 as is the case with the heating side manifold 2. This shaft fixture 22 includes a cylindrical shaft support 22*a*. This shaft support 22*a* is supported coaxially within the second hollow portion 20*b* by means of ribs 22*b*. The shape, the position and the number of the ribs 22*b* are similar to those in the previously described heating side manifold 2 and the three ribs 22*b* are provided radially in the second hollow portion 20*b* with their opposite ends integrally connected with a side surface of the shaft support 22*a* to thereby support the shaft support 22*a* centrally within the second hollow portion 20*b*. The shaft support 22*a* lies at a location bridging between the second hollow portion 20*b* and the cavity 20*d*.

A support shaft 23 made of stainless steel or the like is integrally fixed on the shaft support 22*a* of the shaft fixture 22, which shaft 23 is fixedly supported in coaxial relation to the second hollow portion 20*b*.

Even the cooling side manifold 3 is provided with a pipe-like heat transfer medium outlet 24, but the angle of the heat transfer medium outlet 24 is different from the previously described heating side manifold 2. In other words, while in the heating side manifold 2 the pipe-like portion 14*a* of the heat transfer medium outlet 14 lies on the same plane as the second cavity 10*d* and extends in a direction tangential to the second cavity 10*d*, a pipe-like portion 24*a* in the cooling side manifold 3 is, as shown in FIGS. 1 and 3, fitted at an angle inclined outwardly relative to a plane of the cavity 20*d*.

Figure 3:
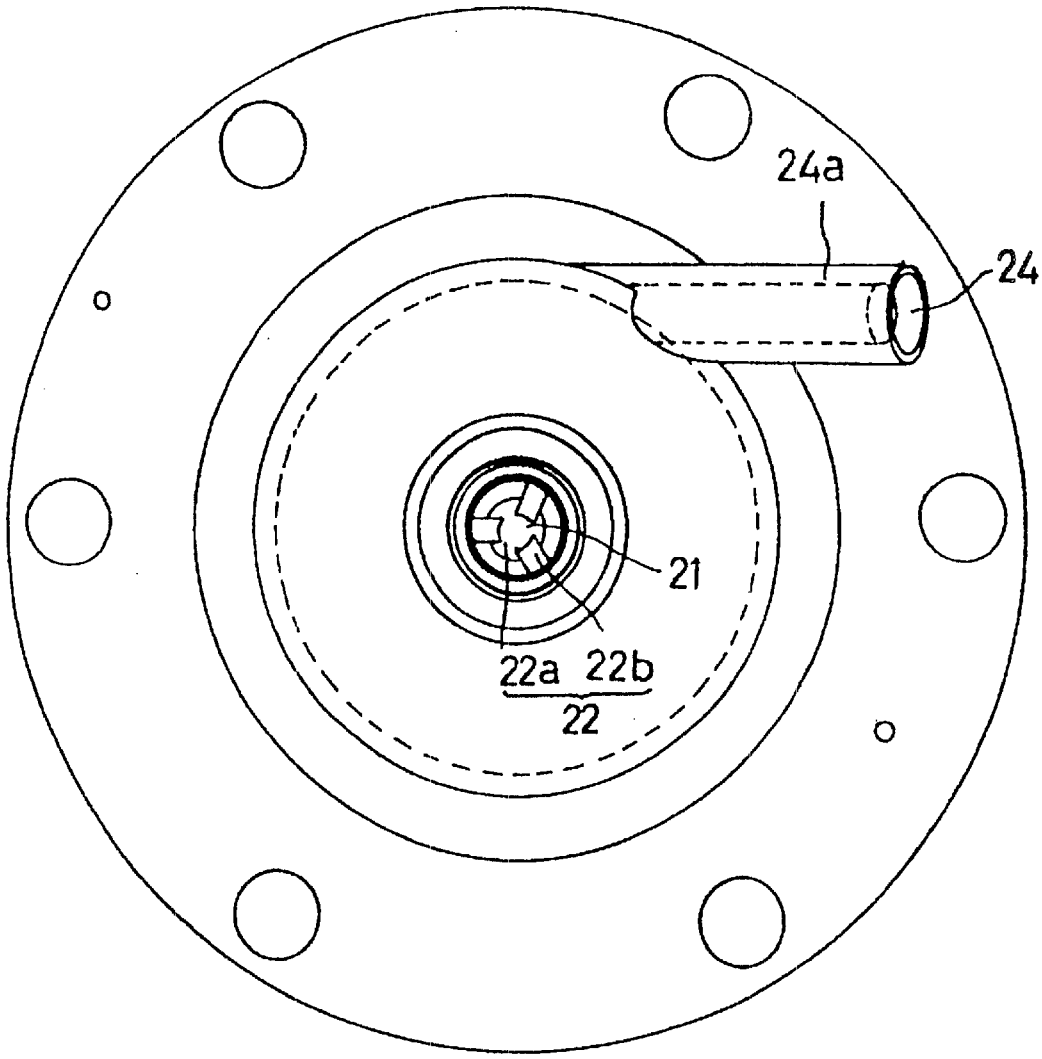
FIG. 3 is a left hand side view of the manifold shown in FIG. 1.
Figure 4:
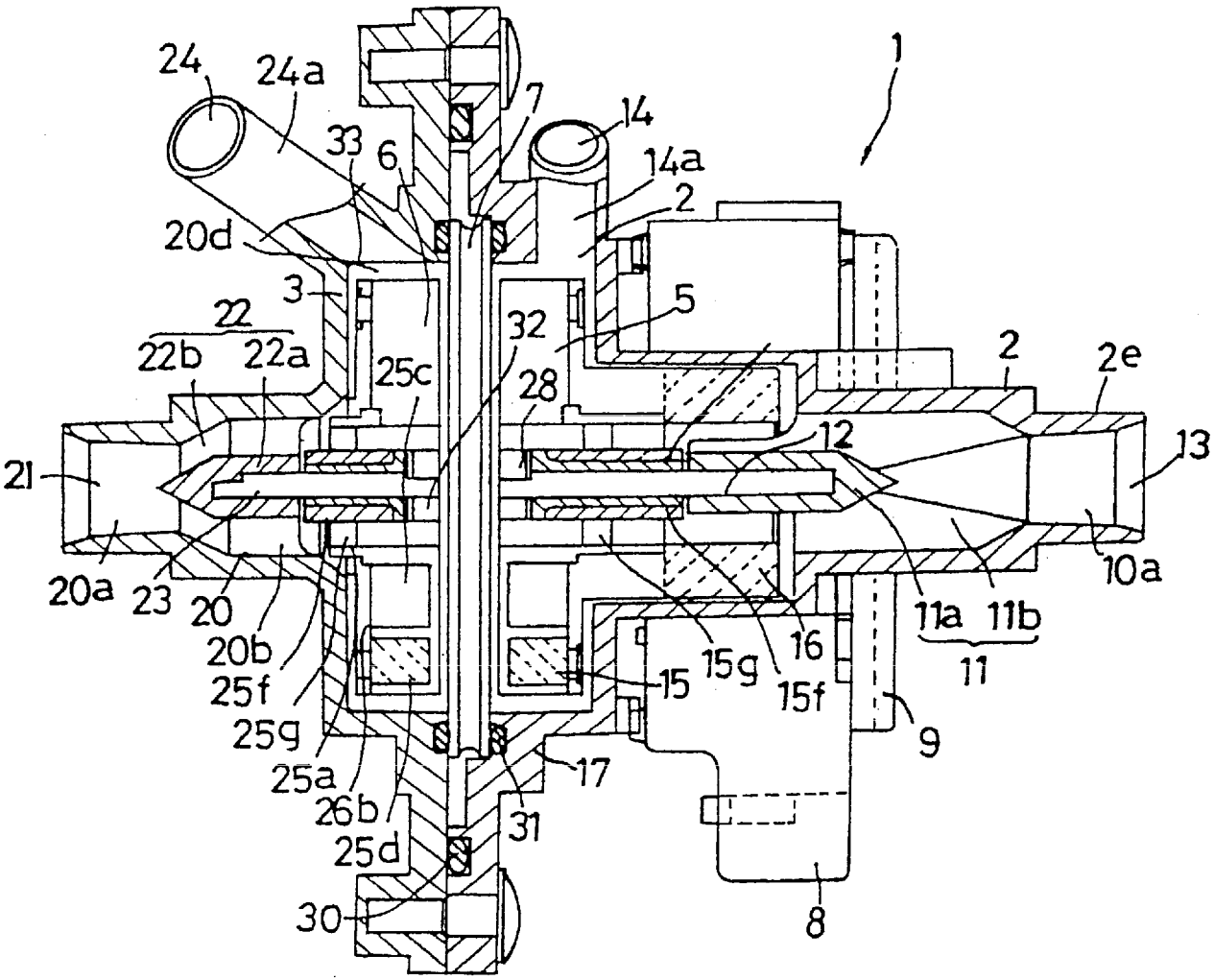
FIG. 4 is a longitudinal sectional view of the manifold shown in FIG. 1.

In other words, in the cooling side manifold 3, the pipe-like portion 24*a* when viewed in a projected side view as shown in FIG. 3, extends in a direction tangential to the cavity 20*d*, but an open portion lies on a plane different from the cavity 20*d* as is clear from the front elevational view thereof. In other words, in the cooling side manifold 3, the pipe-like portion 24*a* is fitted in the form as inclined relative to the plane of the cavity 20*d*.

The cooling side stirring member 6 has only a stirring blade (stirring portion). In other words, the cooling side stirring member 6 has no stator. The cooling side stirring member 6 is of a shape generally similar to the vanes 15*c* of the heating side stirring member 5 and includes a boss portion 25*a* and a disc portion 25*b*, with four vanes 25*c* provided on one of opposite surfaces of the disc portion 25*b*. As is the case with the previously described vanes 15*c*, the vanes 15*c* are slender at a center portion and have a width progressively increasing towards the outer circumstance and are of a clockwise-twisted shape.

Cubic permanent magnets 25*d* are fitted inside the respective vanes 25*c*. These permanent magnets 25*d* have their polarities opposite to those of the permanent magnets 15*d* provided in the vanes 15*c* of the previously described heating side stirring member 5. In other words, the permanent magnets 25*d* are so arranged as to magnetically attract the permanent magnets 15*d* with the thermoelectric module 7 intervening therebetween.

It is to be noted that the polarities of the permanent magnets 25*d* provided in the cooling side stirring member 6 may be the same as those of the permanent magnets 15*d* provided in the heating side stirring member 5 so that they can magnetically repel each other. Also, some of the permanent magnets 15*d* and 25*d* in the cooling side stirring member 6 and the heating side stirring member 5, or ones of the permanent magnets 15*d* and 25*d* may be replaced with magnetic elements such as, for example, iron pieces.

Except for the boss portion 25*a* having a relatively small overall length, the shape and the structure of the boss portion 25*a* are substantially identical with that in the previously described heating side stirring member 5. In other words, ribs 25*g* are provided inside the boss portion 25*a* and a tubular bearing member 25*f* is retained by these ribs 25*g* at a location aligned with a center axis. Each of the ribs 25*g* is in the form of a plate having its surface inclined relative to the axis.

These ribs 25*g* serve, in addition to support for the bearing member 25*f*, as vanes. When the heat transfer medium flows through the boss portion 25*a*, the heat transfer medium is convolved by the ribs 25*g* and is therefore urged.

The relation between the cooling side manifold 3 and the cooling side stirring member 6 is substantially identical with that of the heating side, and the cooling side stirring member 6 is disposed within the cavity 20*d* of the cooling side manifold 3. A support shaft 23 of the cooling side manifold 3 is inserted into the bearing member 25*f* of the cooling side stirring member 6 with a bushing 33 interposed therebetween. A stop member 32 is fitted to a tip of the support shaft 23. This stop member 32 is crimped to the support shaft 23 to thereby avoid separation thereof from the support shaft 23. Accordingly, a front end face of the bearing member 25*f* is held in contact with the stop member 32 through a collar of the bushing 33, and an axially acting force of the cooling side stirring member 6 towards the thermoelectric module 7 is supported by the stop member 32. Accordingly, in the illustrated embodiment, although the cooling side stirring member 6 is rotatable about an axis perpendicular to the endothermic surface of the thermoelectric module 7, the cooling side stirring member 6 is fixed to the cooling side manifold 3 with respect to an axial direction thereof. In the condition in which the cooling side stirring member 6 is mounted on the cooling side manifold 3, the stop member 32 is positioned a slight distance inwardly of a flange surface of the flange 3*a* of the cooling side manifold 3.

Also, in the condition in which the cooling side manifold 3 and the cooling side stirring member 6 are assembled together, the heat transfer medium inlet 21 of the cooling side manifold 3 and a front surface side of the disc portion of the cooling side stirring member 6 are communicated with each other.

Figure 14:
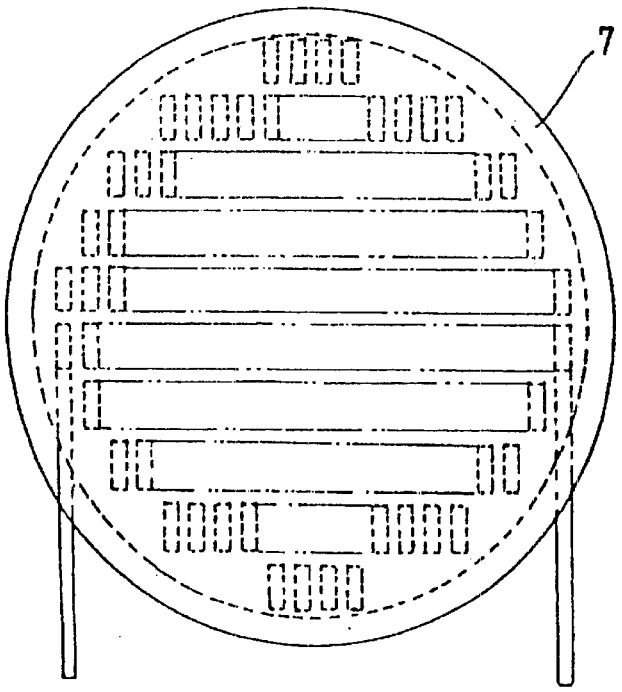
FIG. 14 is a front elevational view of the thermoelectric module employed in the manifold shown in FIG. 1.
Figure 13A:
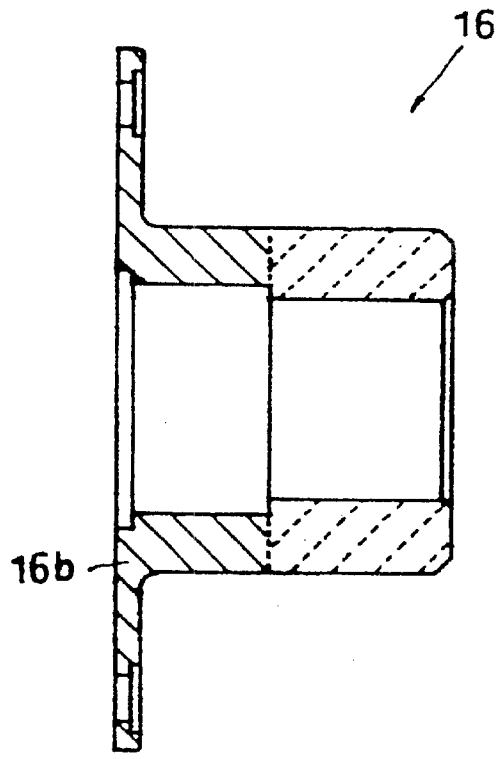
FIG. 13A is a longitudinal sectional view of a rotor used in the manifold shown in FIG. 1.
Figure 13B:
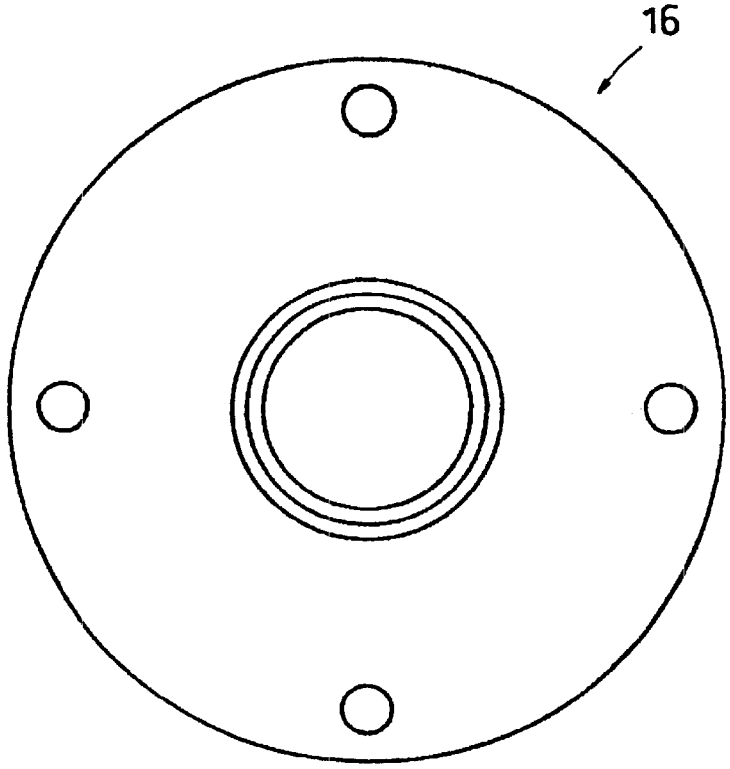
FIG. 13B is a left hand side view of the rotor shown in FIG. 13A.
Figure 15:
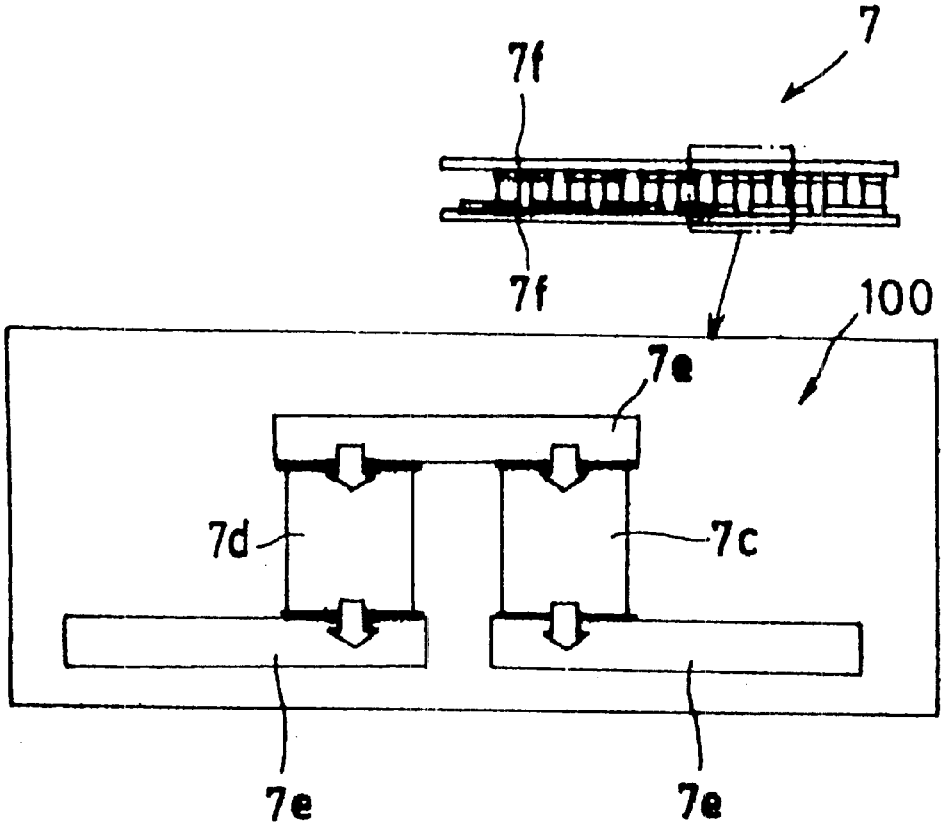
FIG. 15 is a partial enlarged side view of the thermoelectric module shown in FIG. 14.

In the following description, other component parts will be described. In the illustrated embodiment, the thermoelectric module 7 is of a disc-like shape as shown in FIG. 14. This thermoelectric module 7 makes use of any known Peltier element and includes P- and N-type semiconductors juxtaposed with each other. This thermoelectric module has such a sectional structure as shown in FIG. 15 wherein P- and N-type thermoelectric semiconductors 7*c* and 7*d* are connected in series with each other by means of upper and lower electrodes 7*e*, the resultant assembly being fixedly clamped by upper and lower insulating plates 7*f* made of ceramics. It is to be noted that a combination of the P-type thermoelectric semiconductor 7*c* and the N-type thermoelectric semiconductor 7*d* represents a unitary element of the Peltier element. The thermoelectric module 7 employed in the illustrated embodiment is of a design in which as shown in FIG. 14 the Peltier elements are arranged in a round pattern as shown. It is to be noted that in the thermoelectric module 7 employed in the illustrated embodiment, no Peltier element is arranged in an outer peripheral portion of the disc.

For the thermoelectric module 7, it is possible to employ a single rectangular thermoelectric module sandwiched between aluminum discs.

The stator 8 is of a type incorporating a coil forming a motor. This stator 8 has an outer diametric shape similar to a ring shape as shown in FIGS. 7, 8A to 8D and 9, having a hole (opening) 8*a* defined at the center thereof. An electrode portion 8*b* is also provided at a side thereof.

Figure 16A:
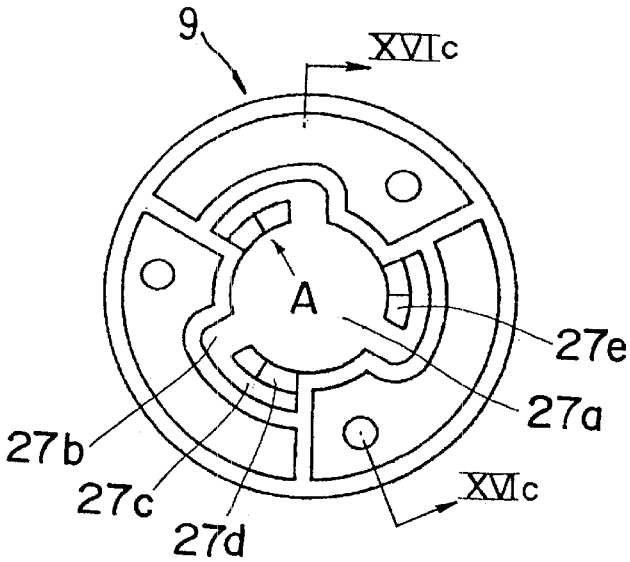
FIG. 16A is a front elevational view of a fixing ring.
Figure 16B:
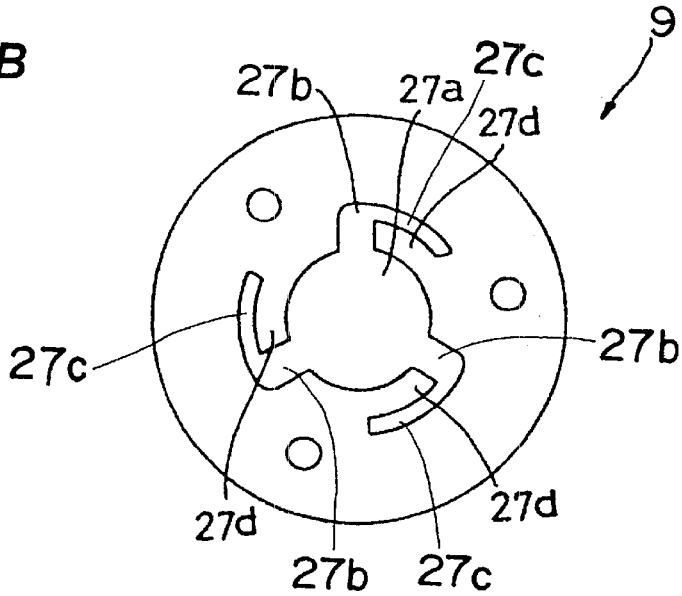
FIG. 16B is a rear view of the fixing ring.
Figure 16C:
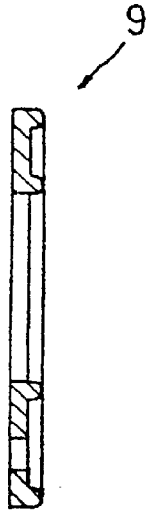
FIG. 16C is a sectional view taken along the line XVIc—XVIc in FIG. 16A.

The fixing ring 9 is in the form of a disc as shown in FIGS. 16A and 16B and is formed with an opening 27 of a special shape similar to the shape of 卍. The details of the shape of the opening 27 are as follows.

Specifically, a center portion of the fixing ring 9 is formed with a round opening 27*a* communicated with three radially outwardly extending grooves 27*b*. The grooves 27*b* extend straight so that each has an axis extending through the center of the round opening 27*a*.

Also, radially outer ends of the straight grooves 27*b* are turned in the same direction to thereby define respective turned grooves 27*c* which extend arcuately to follow the curvature of the round opening 27*a*.

Since the fixing ring 9 is provided with the straight grooves 27*b* and the turned grooves 27*c*, respective portions of the fixing ring 9 bound between the neighboring grooves are left in the form of a peninsula. In other words, the fixing ring 9 is provided with three peninsulas 27*d* around the round opening 27*a*.

Figure 16D:
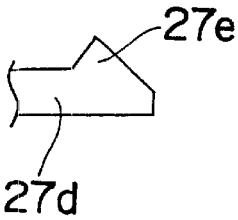
FIG. 16D is a side view as viewed in a direction shown by the arrow A in FIG. 16A.

Viewing front and rear sides of the fixing ring 9, the rear side of the fixing ring 9 is smooth as shown in FIG. 16B. In contrast thereto, the front side of the fixing ring 9 is provided with reinforcement ribs at all ends thereof as shown in FIG. 16A. Also, as shown in FIG. 16D, front side ends of the peninsulas 27*d* are each formed with an engagement projection 27*e* having an inclined tip.

Assemblage of the manifold 1 will now be described. In the manifold 1, the heating side manifold 2 and the cooling side manifold 3 are integrated together with the O-ring 30 interposed therebetween, and the thermoelectric module 7 is disposed at a center portion thereof while having been sandwiched between the two O-rings 31. In other words, the heating side manifold 2 and the cooling side manifold 3 are integrally coupled together with the thermoelectric module 7 mounted at an intermediate portion thereof.

Figure 6:
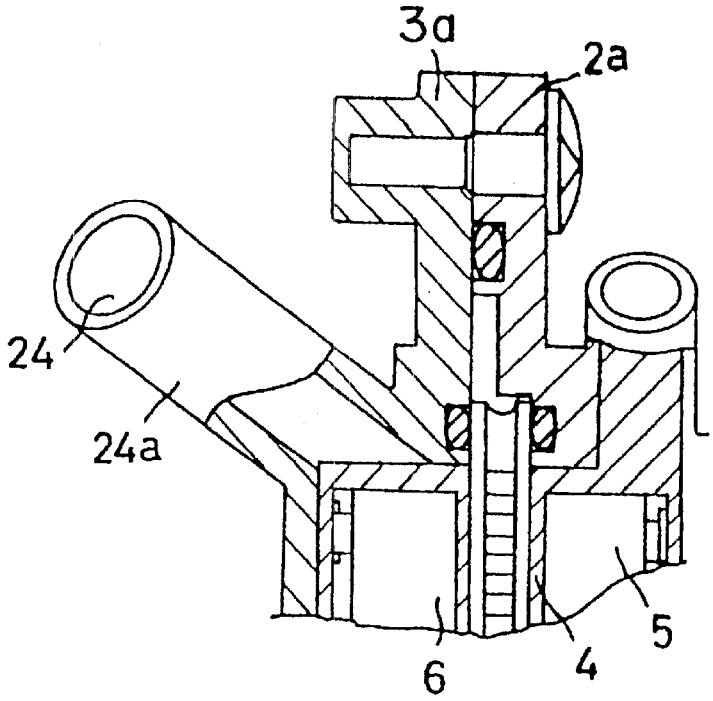
FIG. 6 is an enlarged sectional view of one end portion of the thermoelectric module provided in the manifold shown in FIG. 4.
Figure 9:
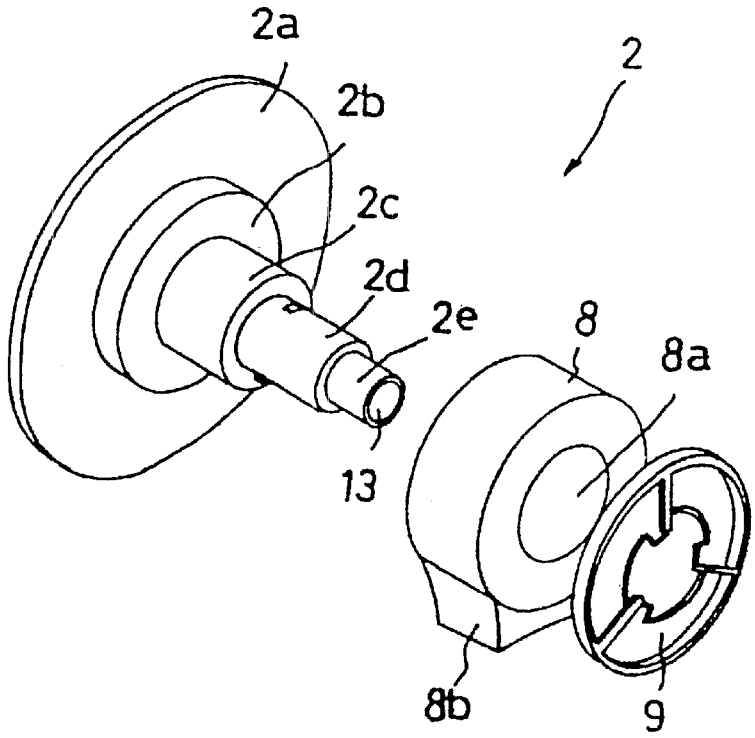
FIG. 9 is a detailed exploded perspective view showing a stator and its vicinity in the manifold shown in FIG. 1.
Figure 7:
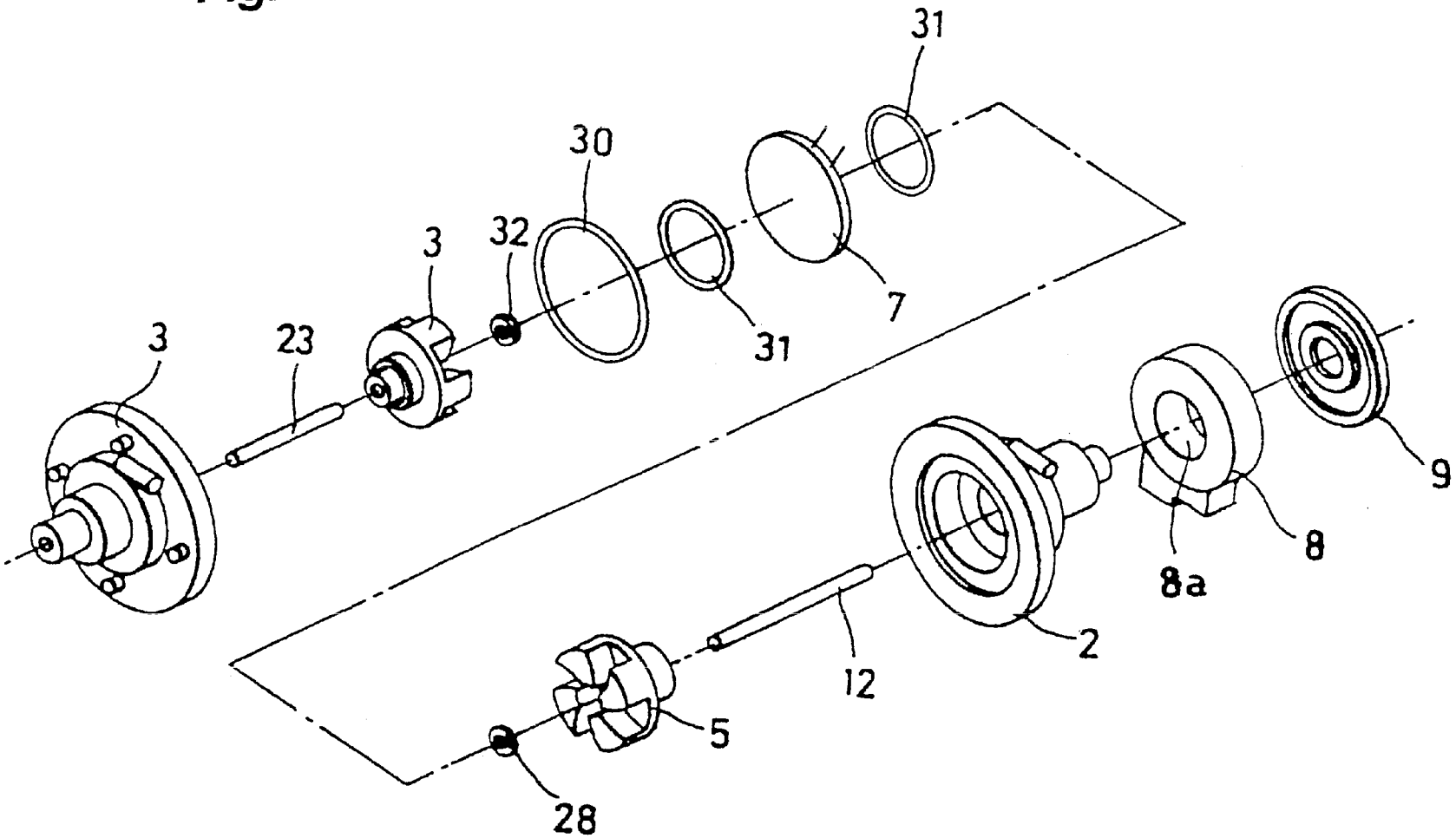
FIG. 7 is an exploded perspective view of the manifold shown in FIG. 1.
Figure 8C:
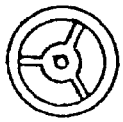
FIG. 8C is a sectional view showing a small diameter boss portion of the heating side manifold.
Figure 8D:
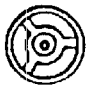
FIG. 8D is a sectional view of a boss portion of the heating side stirring member.
Figure 8A:
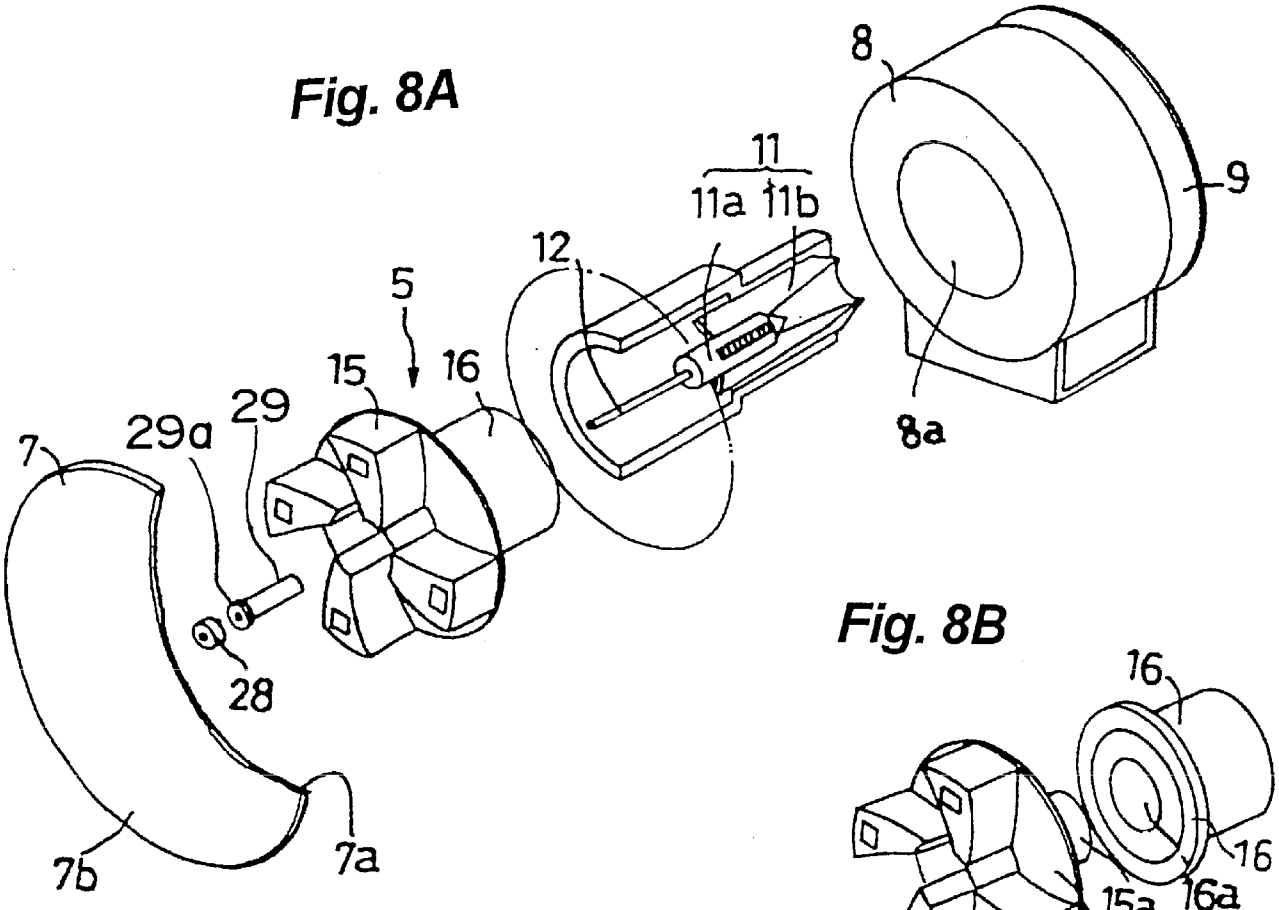
FIG. 8A is a detailed exploded perspective view of a heating side of the manifold shown in FIG. 1.
Figure 8B:
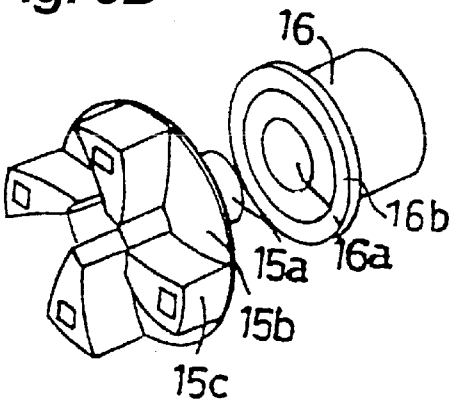
FIG. 8B is an exploded perspective view of a heating side stirring member.
Figure 10A:
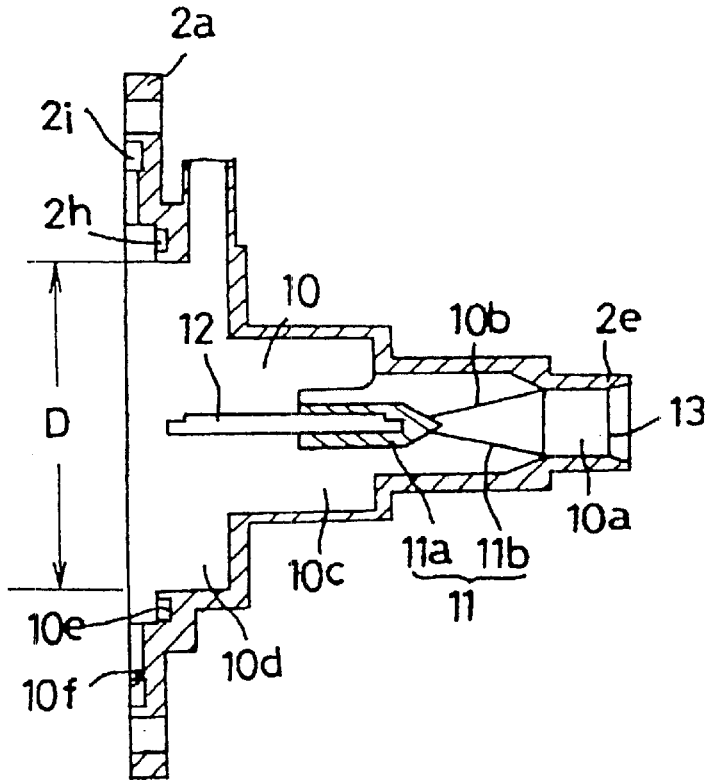
FIG. 10A is a front elevational view of the heating side manifold in the manifold shown in FIG. 1.
Figure 10B:
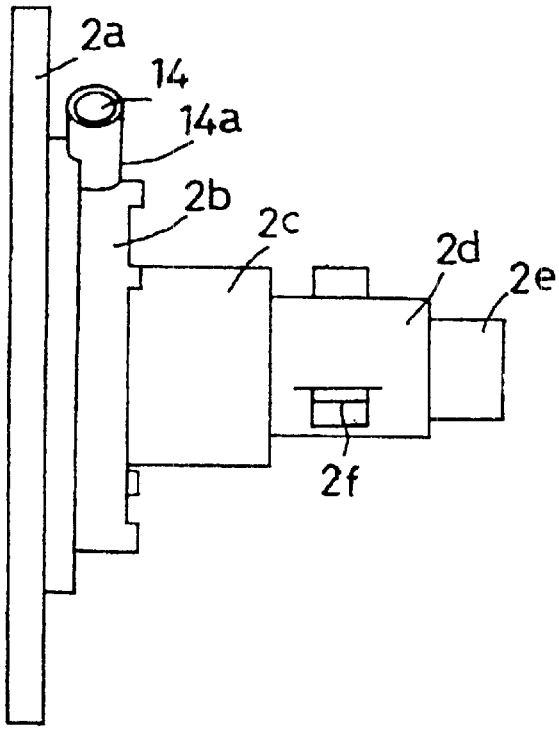
FIG. 10B is a sectional view of the heating side manifold shown in FIG. 10A.

Coupling of the heating side manifold 2 and the cooling side manifold 3 is carried out by aligning and mating the respective flanges 2*a* and 3*a* with each other and then fastening them together by means of screws passing therethrough. Looking carefully at the joint therebetween, as shown in, FIG. 6, a peripheral portion of the thermoelectric module 7 where no Peltier elements are disposed is clamped between the heating side manifold 2 and the cooling side manifold 3. In other words, the Peltier elements are arranged only at a location aligned with the cavities 10*d* and 20*d*. The peripheral portions of the thermoelectric module 7 where no Peltier element exists is held in contact with the O-rings 31.

In the illustrated embodiment, by allowing that portion where no Peltier element exists to be sandwiched between the heating side manifold 2 and the cooling side manifold 3, the medium heated or cooled by the Peltier elements is prevented from being conducted to the heating side manifold 2 and the cooling side manifold 3.

Although in the illustrated embodiment the heating side manifold 2 and the cooling side manifold 3 are provided with the respective stirring members 5 and 6, the axially acting force of any one of the stirring members 5 and 6 is supported by the associated stop member 28 or 32 crimped to the corresponding support shaft 12 or 23 so as to be integrally fixed to the associated manifold 2 or 3 in the axial direction. In the condition in which the stirring members 5 and 6 are mounted inside the respective manifolds 2 and 3, the stop members 28 and 32 are positioned at respective locations a slight distance inwardly of the flange surfaces of the associated flanges 2*a* and 3*a*. More specifically, the stop member 26 has its tip positioned at a location closer to the heat transfer medium inlet 13 than to the first stage 2*i* of the opening of the heating side manifold 2. For this reason, the stop members 28 and 32 and the stirring members 5 and 6 are not held in contact with the thermoelectric module 7, but a gap 4 is formed between each of the stirring members 5 and 6 and the thermoelectric module 7. This gap has a gap size of about 1 to 2 mm.

Also, the stator 8 is externally mounted on the boss portion 2*c* of the heating side manifold 2. A method of fixing the stator 8 is as follows.

The boss portion 2*c* of the heating side manifold 2 is first inserted into the hole 8*a* in the stator 8 and, following the stator 8, the fixing ring 9 is externally mounted on the heating side manifold 2. When the fixing ring 9 is to be mounted, after the grooves 27*b* and the projections 2*f* have been aligned with each other as shown in FIG. 17A, the fixing ring 9 is pushed towards the stator 8 with the projections 2*f* consequently engaged into the associated grooves 27*b* and, at this time, the peninsulas 27*d* of the fixing ring 9 are brought to respective locations adjacent the flange 2*a* rather than the projections 2*f* without interfering with the projections 2*f*.

Figure 17A:
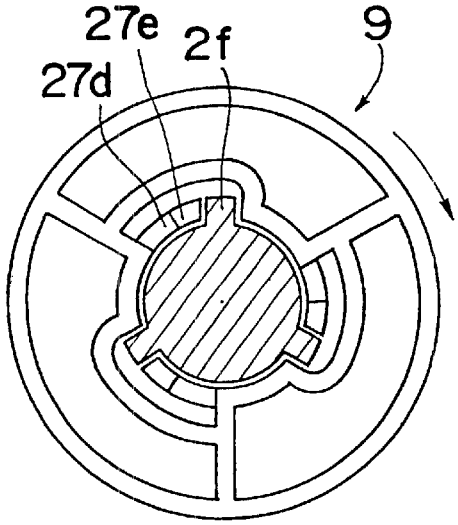
FIG. 17A is a front elevational view showing a condition of the fixing ring before it is fastened.
Figure 17B:
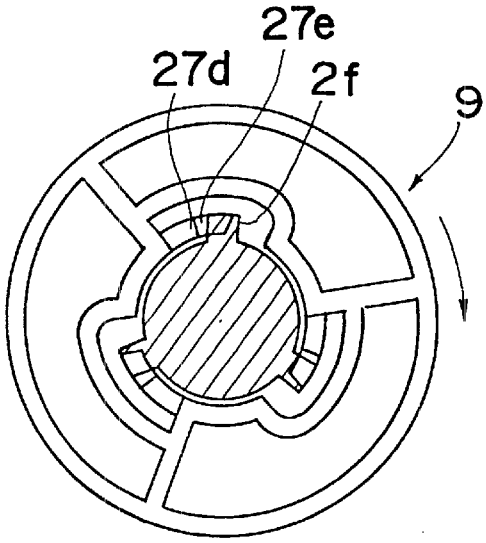
FIG. 17B is a front elevational view showing the fixing ring being fastened by rotation.
Figure 17C:
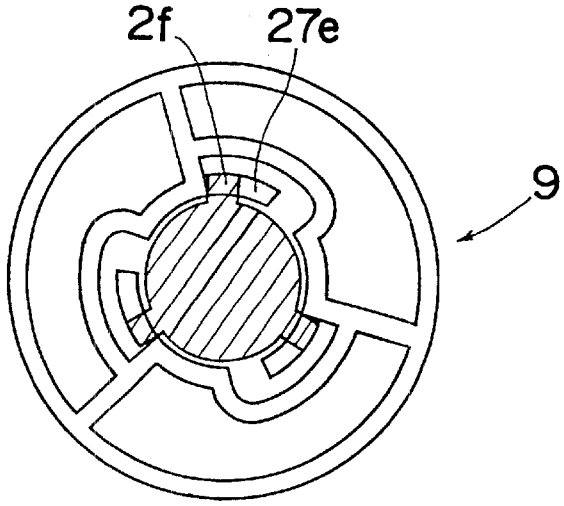
FIG. 17C is a front elevational view showing a condition of the fixing ring having been fastened.

Then, as shown in FIGS. 17A and 17B, the fixing ring 9 is turned in a direction shown by the arrow, causing the projections 2*f* to engage the inclined faces of the engagement projections 27*e* of the respective peninsulas 27*d* while the peninsulas 27*d* are rearwardly pushed to deform elastically. Further turning of the fixing ring 9 in the direction shown by the arrow results in the projections 2*f* riding over the corresponding engagement projections 27*e* of the peninsulas 27*d* and are then retained in position between the engagement projections 27*e* and the reinforcement ribs as shown in FIG. 17C. As a result thereof, the stator can thus be integrally fixed on the boss 2*c* of the heating side manifold 2.

The operation of the manifold 1 according to the illustrated embodiment will now be described.

Figure 18:
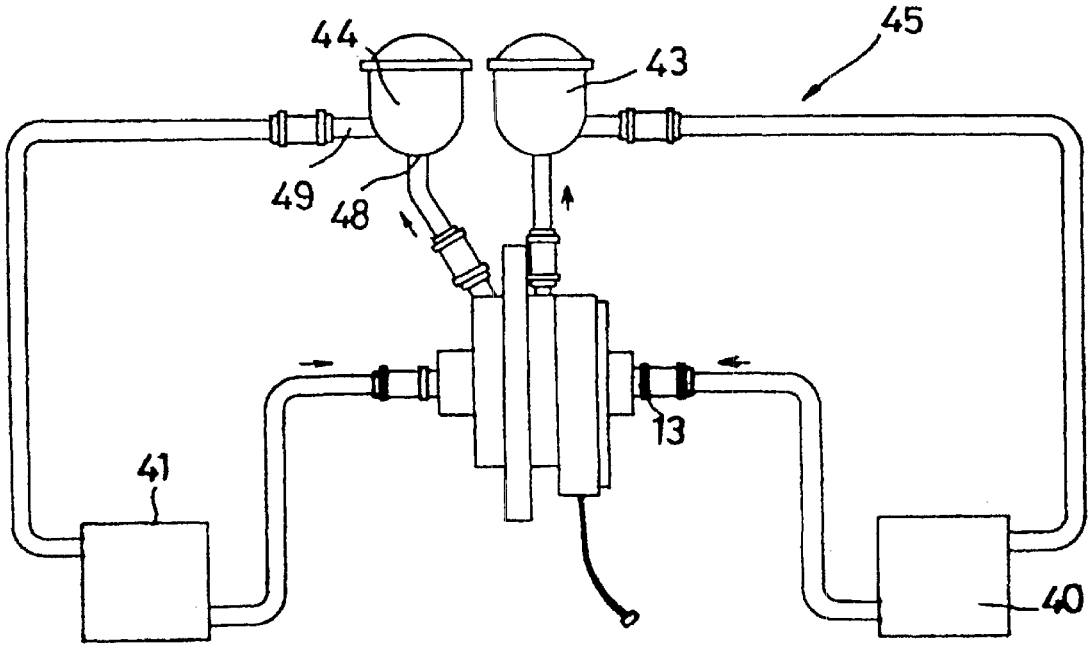
FIG. 18 is a structural diagram showing a freezer utilizing the manifold shown in FIG. 1.

This manifold 1 is utilized as a part of a freezer 45 that includes heat exchangers 40 and 41 and air ventilating chambers 43 and 44 such as shown in FIG. 18.

Figure 19:
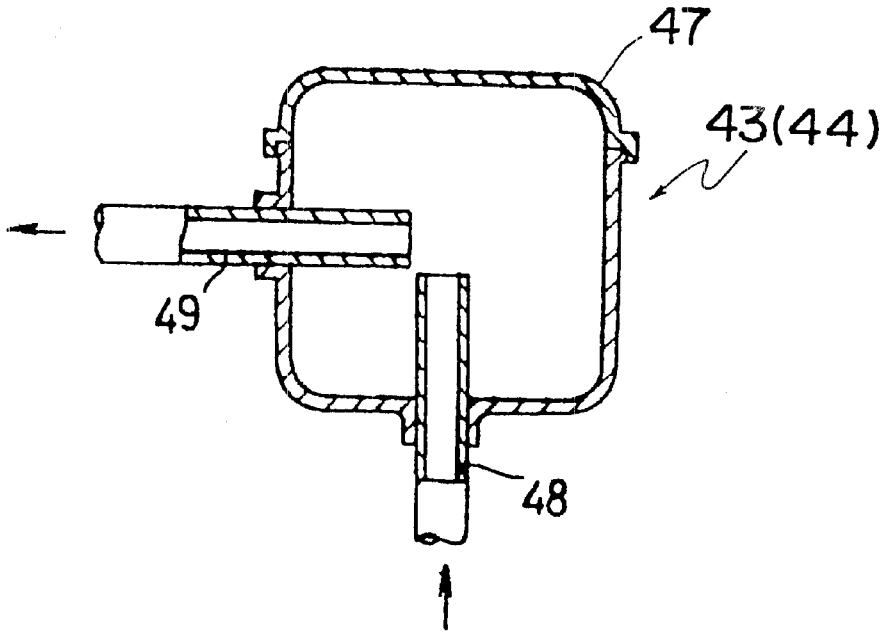
FIG. 19 is a sectional view showing an air ventilating chamber.

The high temperature side air ventilating chamber 43 and the low temperature side air ventilating chamber 44 are used to collect gases that are contained in a piping system for any reason and to prevent the gases from being circulated in the piping system and also to facilitate a smooth circulation of the heat transfer medium even though the quantity of the heat transfer medium is reduced for any reason. The air ventilating chambers 43 and 44 are disposed in respective spaces where the gases are built up in the piping system and have respective maximum capacity portions that are positioned at the highest level of the piping system A specific structure of each of the air ventilating chambers 43 and 44 is such as shown in FIG. 19 and includes a tank-like vessel 47 having a heat transfer medium intake port 48 and a heat transfer medium discharge port 49 both defined therein.

As a structural feature peculiar to the illustrated embodiment, any one of the heat transfer medium intake port 48 and the heat transfer medium discharge port 49 makes use of a pipe. The pipe forming the heat transfer medium intake port 48 extends into the vessel 47 through a center portion of the bottom of such vessel 47. The pipe forming the heat transfer medium intake port 48 within the vessel 47 extends to a position adjacent the center of gravity of the vessel 47 while opening in the vicinity of the center of gravity of the vessel 47.

On the other hand, the pipe forming the heat transfer medium discharge port 49 extends into the vessel 47 through a center portion of a side of the vessel 47. Even the pipe forming the heat transfer medium intake port 48 within the vessel 47 extends to a position adjacent the center of gravity of the vessel 47 while opening in the vicinity of the center of gravity of the vessel 47.

Since the air ventilating chambers 43 and 44 employed in the illustrated embodiment have the heat transfer medium intake port 48 and the heat transfer medium discharge port 49 that open in the vicinity of the centers of gravity of the respective vessels 47, the air ventilating chambers 43 and 44 have no directionality. In other words, although it is preferred that the air ventilating chambers 43 and 44 are used while assuming respective postures as shown in FIG. 19, the respective openings of the heat transfer medium intake port 48 and the heat transfer medium discharge port 49 are immersed in the heat transfer medium at all times regardless of whether they are positioned by having been inclined or inverted for any reason. For this reason, the air ventilating chambers 43 and 44 will not suck any air (or gas) through the respective openings of the heat transfer medium intake port 48 and the heat transfer medium discharge port 49 within the vessels 47 even when they are used in an inclined posture.

Figure 20:
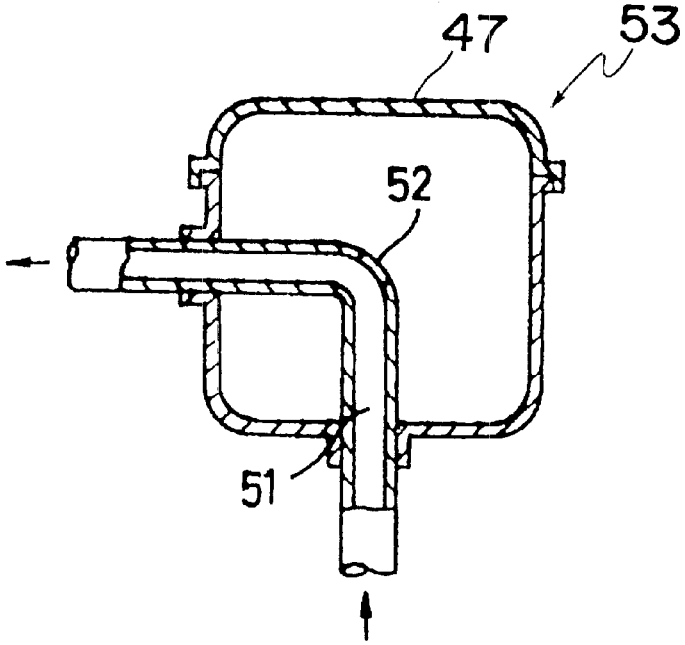
FIG. 20 is a sectional view showing a modification of the air ventilating chamber.

As an air ventilating chamber expected to exhibit similar functions and effects, there is such an air ventilating chamber 53 as shown in FIG. 20. In the air ventilating chamber shown in FIG. 20, each of the heat transfer medium intake port 48 and the heat transfer medium discharge port 49 shown in FIG. 19 is constituted by a single pipe 51 that is bent to represent an L-shape. In the illustrated embodiment, a bent portion of the pipe 51 is positioned adjacent the center of gravity of the vessel 47, and an opening 52 is defined at such bent portion.

Referring again to the description of the freezer 45, a high temperature side of the manifold 1 is fluid connected with a heat radiating condenser (heat exchanger) 40 and the high temperature side air ventilating chamber 43.

More specifically, a discharge port of the heat radiating condenser (heat exchanger) 40 and the heat transfer medium intake port 13 of the manifold 1 are connected together. Also, the heat transfer medium discharge port 14 of the manifold 1 and the intake port 40 of the high temperature air ventilating chamber 43 are connected together. Also, the heat transfer medium discharge port 49 of the high temperature air ventilating chamber 43 and an intake port of the heat radiating condenser (heat exchanger) 40 are connected together.

In this way, a closed circuit including a series of the high temperature side of the manifold 1, the high temperature side air ventilating chamber 43 and the heat radiating condenser (heat exchanger) 40 can be defined.

The piping system on a cooling side of the manifold 1 is also similar to that described above, wherein an endothermic evaporator (heat exchanger) 41 and the temperature side air ventilating chamber 44 are fluid connected together to define a closed circuit.

Within the piping system, the heat transfer medium containing water as a principal component circulates. It is to be noted that an antifreezing solution such as, for example, polypropylene glycol is preferably added within the piping system on the cooling side. While it is preferred that the heat transfer medium is employed in the form of a fluid medium containing water as a principal component because of a relatively large specific heat, any other fluid medium may be employed therefor.

In the freezer in the illustrated embodiment, since the manifold 1 concurrently serves as a pump for moving the heat transfer medium, no extra pump is employed.

In this condition, electric power is supplied to the thermoelectric module 7 of the manifold 1 and also to the stator 8.

As a result, the temperature of the heating side heat transfer surface (exothermic surface) 7*a* of the thermoelectric module 7 increases while that of the cooling side heat transfer surface (endothermic surface) 7*b* decreases.

On the other hand, the stator 8 is electrically energized to exert a magnetic force which acts on the rotor 16 within the heating side manifold 2 through the heating side manifold 2. Consequently, a rotational force is generated in the rotor 16 within the heating side manifold 2. In other words, in the manifold 1 having the thermoelectric module built therein in accordance with the illustrated embodiment, the motor is comprised of the rotor 16 and the stator 8 positioned inside and outside the heating side manifold 2. For this reason, supply of electric power to the stator 8 results in rotation of the rotor 16 within the heating side manifold 2. As a result thereof, the heating side stirring member 5 integrated with the rotor 16 rotates with the stirring blade (stirring portion) 15 of the heating side stirring member 5 starting its rotation.

In the manifold 1 having the thermoelectric module built therein according to the illustrated embodiment, since the rotor 16 of the motor is provided in the heating side manifold 2, no shaft seal is needed. In other words, since the rotor 16 is caused to rotate within the sealed heating side manifold 2, fluid sealability is assured and leakage of the heat transfer medium is minimized.

Also, in the manifold 1 according to the illustrated embodiment, the magnets 15*d* and 25*d* are fitted to the stirring members 5 and 6, respectively, and the stirring members 5 and 6 are arranged in a fashion opposed to each other with the thermoelectric module 7 intervening therebetween while the respective polarities of the magnets 15*d* and 25*d* are laid to magnetically attract each other. For this reason, the magnets 15*d* and 25*d* of the stirring members 5 and 6 attract each other and, accordingly as the heating side stirring member 5 within the second cavity 10*d* on the heating side rotates, the cooling side stirring member 6 on the cooling side rotates.

In other words, supply of the electric power to the stator 8 results in rotation of the stirring members 5 and 6 within the respective cavities.

Accordingly, even on the cooling side of the manifold 1, the stirring member 6 rotates while it maintains a sealed condition.

Thus, the heat transfer medium within each cavity rotates, and energy is imparted to the heat transfer medium. The heat transfer medium having imparted a rotational force is discharged outwardly from the heat transfer discharge ports 14 and 24. In this way, the manifold 1 having the thermoelectric module built therein according to the illustrated embodiment can function as a pump, but the flow path for the heat transfer medium inside it is unique.

In other words, in the heating side of the manifold 1, the heat transfer medium enters the heat transfer medium inlet 13 at the end of the heating side manifold 2. This heat transfer medium then flows through the first hollow portion 10*a* within the small diameter tubular portion 2*e*. Thereafter, the heat transfer medium passes between the ribs 11*b* in the second hollow portion 10*b* within the large diameter tubular portion 2*d*. The heat transfer medium further flows through the boss portion 15*a* of the heating side stirring member 5 and subsequently through the ribs 15*g* before it reaches the front surface opening of the disc portion 15*b* of the heating side stirring member 5. Thus, the fluid flows through a portion of the opening 16*a* of the rotor 16 (while flowing in part through an outer peripheral portion of the rotor 16) and flows directly into the second cavity 10*d* by way of the straight passage. For this reason, the loss of pressure within the manifold 1 is small.

The foregoing description equally applies to the cooling side, and the heat transfer medium enters the heat transfer medium inlet 21 at the end of the cooling side manifold 3, flows through the first hollow portion 20*a*, then flows through the ribs 22*b* within the second hollow portion 20*b* and finally flows through the boss portion 25*a* of the cooling side stirring member 6 before it reaches the center of the vanes 25*c* of the cooling side stirring member 6.

In the manifold 1 according to the illustrated embodiment, the heat transfer medium flows through the straight passage and then directly into a central portion of the vanes 15*c* and 25*c* of the respective heating side stirring members 5 and 6. Since the central portions of the vanes 15*c* and 25*c* are where negative pressure tends to develop as a result of rotation, the manifold 1 can exhibit high efficiency as a pump.

Also, the heat transfer medium having entered the central portion of the vanes 15*c* and 25*c* is stirred by the vanes 15*c* and 25*c* so that the heat transfer medium can contact the exothermic or endothermic surfaces of the thermoelectric module 7 at a high frequency. In particular, since in this manifold 1 the vanes 15*c* and 25*c* and the adjacent surfaces of the thermoelectric module 7 are spaced by the intervention of the respective gaps of about 1 to 2 mm, the heat transfer medium flows into these gaps to contact the heat transfer surfaces 7*a* and 7*b* of the thermoelectric module 7 at a high frequency. Also, in the illustrated embodiment, since the gap is present between the tip of the stop member 28 and the thermoelectric module 7, the heat transfer medium also convolutes into a center portion of the thermoelectric module 7 at which heat exchange takes place at such center portion of the thermoelectric module 7.

Also, in the illustrated embodiment, the ribs 15*g* and 25*g* provided inside the respective boss portions 15*a* and 25*a* of the stirring members 5 and 6 are in the form of a plate and have their surfaces inclined relative to the axis as shown in FIG. 12. These ribs 15*g* and 25*g* rotate together with the associated stirring members 5 and 6. For this reason, as the heat transfer medium passes through the boss portions 15*a* and 25*a*, the heat transfer medium is convolved and urged by the ribs 15*g* and 25*g* and, accordingly, a higher efficiency can be expected. In other words, rotation of the ribs 15*g* and 25*g* allows a function similar to an axial flow pump to be exhibited and, accordingly, the heat transfer medium is urged to collide directly against the thermoelectric module.

The heat transfer medium having entered into the center portions of the vanes 15*c* and 25*c* is urged by rotation of the vanes 15*c* and 25*c* and is discharged from the heat transfer medium outlets 14 and 24. As the heat transfer medium is so discharged, a fresh heat transfer medium is sucked in through the heat transfer inlets 13 and 21.

It is to be noted that in the manifold 1 according to the illustrated embodiment, the angle at which the heat transfer outlets 14 and 24 are fitted differs between the heating and cooling sides. Specifically, as hereinbefore described, the pipe-like portion 14*a* on the heating side lies on the same plane as the second cavity 10*d* and extends in a direction tangential to the second cavity 10*d* whereas on the cooling side the pipe-like portion 24*a* is fitted at an angle inclined outwardly relative to the plane of the cavity 20*d*. For this reason, on the heating side the pipe-like portion 14*a* coincides with a vector of the direction in which the heat transfer medium is urged whereas on the cooling side respective vectors are displaced from each other. Accordingly, in the manifold 1 according to the illustrated embodiment, the discharge rate on the heating side and the discharge rate on the cooling side differ from each other.

Also, since within the cavity the heat transfer medium is stirred, there is a high possibility of the heat transfer medium contacting the heat transfer surfaces 7*a* and 7*b*. In particular, in the illustrated embodiment, the heat transfer medium enters in a direction at right angles to the heat transfer surfaces 7*a* and 7*b* of the thermoelectric module 7. For this reason, the heat transfer medium impinges at right angles to the thermoelectric module 7. Accordingly, the manifold 1 according to the illustrated embodiment exhibits a high heat exchange efficiency between the heat transfer medium and the heat transfer surfaces 7*a* and 7*b*.

In addition, this manifold 1 has no rotary shaft that may extend through a wall surface. In other words, since the rotor 16 rotates in the sealed condition accompanied by rotation of the stirring members 5 and 6, leakage of the heat transfer medium is small.

(Embodiment 2)

Hereinafter, a second embodiment of the present invention will be described. It is to be noted that component parts which exhibit functions similar to those in the first embodiment are given like reference numerals and the description will not be reiterated.

Figure 21:
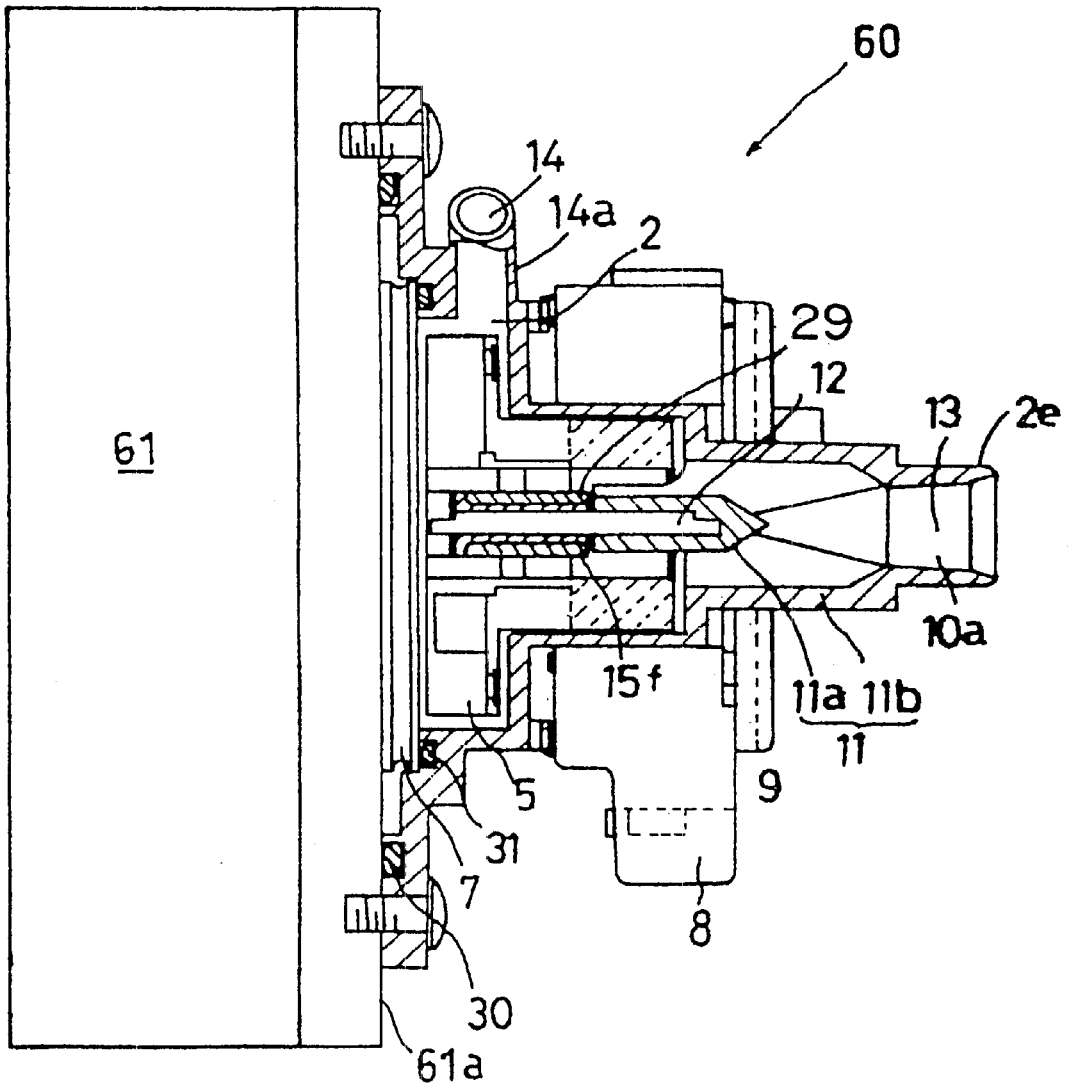
FIG. 21 is a partial sectional view of the manifold incorporating the thermoelectric module according to a second embodiment of the present invention.
Figure 22:
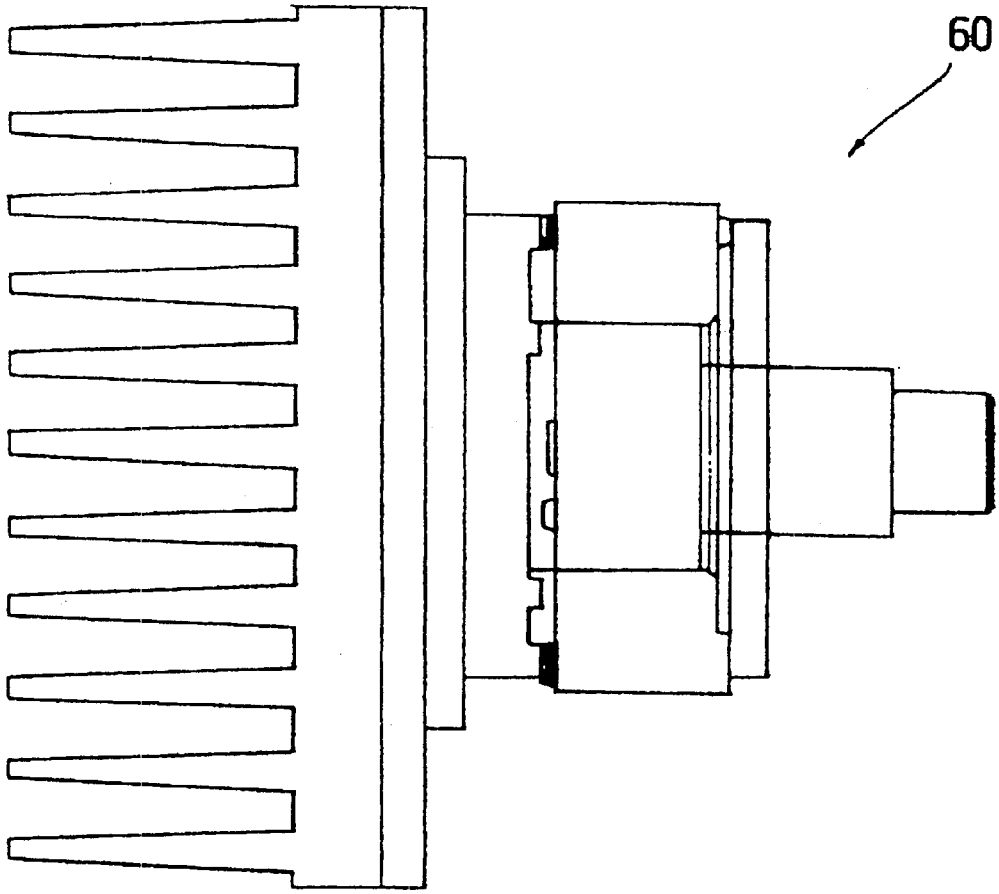
FIG. 22 is a plan view of the manifold shown in FIG. 21.

As shown in FIGS. 21 and 22, in the manifold 60 according to this embodiment, the manifold is employed only on the heating side and no manifold is employed on the cooling side. The heating side manifold 2 is of a structure completely identical with that in the previously described first embodiment and this embodiment is a version in which the cooling side manifold 3 employed in the previous embodiment is replaced with a fin member 61.

In otherwords, in the manifold 60 according to the second embodiment, the cooling side heat transfer surface 7*b* of the thermoelectric module 7 is held in direct abutment with a wall surface (heat conductive plate) 61*a* of the fin member 61. This manifold 60 is desirable for employment in a refrigerator in which air inside it is cooled in contact with the fin member 61.

In any one of the foregoing embodiments of the present invention, the rotor 16 is employed in the form of a permanent magnet, but a winding similar to the standard induction motor can be employed. However, where the winding is used for the stator in the present invention, care must be taken in insulation.

Also, in any one of the foregoing embodiments of the present invention, although a through hole is defined in the center portion of the stirring member 5 to define a flow passage for the heat transfer medium, the clearance between the rotor 16 and the second cavity 10*b* may be increased to define the flow passage for the heat transfer medium.

What is claimed is:

1. A manifold having a thermoelectric module built therein, which is characterized by comprising a thermoelectric module having exothermic and endothermic surfaces, which are heated and cooled, respectively, when an electric current is supplied thereto; a manifold body accommodating therein the thermoelectric module, said manifold having a cavity defined therein for entry of a fluid medium in cooperation with at least one of the exothermic and endothermic surfaces and having a hollow defined therein so as to extend from an outside to the cavity; a stirring member disposed within the manifold body and having a stirring portion integrated together with a rotor for stirring the fluid medium within the cavity; and a stator mounted externally on the manifold body; said rotor and said stator cooperating with each other to form a motor, said stirring member when electric power is supplied to the stator rotating within cavity to allow the fluid medium to flow past an interior of the rotor towards the cavity.

2. The manifold having the thermoelectric module built therein as claimed in claim 1, characterized in that an opening is provided at a center portion of the rotor and the fluid medium flows past such opening.

3. The manifold having the thermoelectric module built therein as claimed in claim 1, characterized in that the stirring member is rotatable about an axis intersecting any one of the endothermic and exothermic surfaces.

4. The manifold having the thermoelectric module built therein as claimed in claim 2, characterized in that the manifold body covers only one of the exothermic and endothermic surfaces of the thermoelectric module, the other of the exothermic and endothermic surfaces of the thermoelectric module being held in abutment with a heat conductive plate.

5. The manifold having the thermoelectric module built therein as claimed in claim 4, characterized in that the stirring member has a center portion having a throughhole defined therein and in that a bearing member is supported within the throughhole by means of ribs, and said bearing member is inserted in a support shaft fixed relative to the manifold body to thereby support the stirring member for rotation.

6. The manifold having the thermoelectric module built therein as claimed in claim 5, characterized in that the ribs for supporting the bearing member are provided with respective inclined surfaces.

7. The manifold having the thermoelectric module built therein as claimed in claim 5, characterized in that the bearing member has a hole defined therein and having a diameter enlarged outwardly at one end face thereof.

8. The manifold having the thermoelectric module built therein as claimed in claim 5, characterized in that the bearing member has one end face provided with a tapered portion.

9. The manifold having the thermoelectric module built therein as claimed in claim 1, characterized in that the manifold body has cavities defined respectively between the thermoelectric module and the endothermic surface and between the thermoelectric module and the exothermic surface, with the stirring member provided in each of the cavities, at least one of the stirring members being provided with magnets, a rotation of one of the stirring members being transmitted to the other of the stirring members by means of a magnetic force.

10. The manifold having the thermoelectric module built therein as claimed in claim 1, characterized in that the manifold body covers only one of the exothermic and endothermic surfaces of the thermoelectric module, the other of the exothermic and endothermic surfaces of the thermoelectric module being held in abutment with a heat conductive plate.

11. A manifold having a thermoelectric module built therein, which is characterized by comprising a thermoelectric module having exothermic and endothermic surfaces, which are heated and cooled, respectively, when an electric current is supplied thereto; a manifold body accommodating therein the thermoelectric module, said manifold body having a cavity defined therein for entry of a fluid medium in cooperation with at least one of the exothermic and endothermic surfaces and having a hollow defined therein so as to extend from an outside to the cavity; and a stirring member disposed within the manifold body for stirring the fluid medium within the cavity, said stirring member having a throughhole defined therein, said through hole being provided with a blade member, the fluid medium being allowed to flow through the throughhole towards the cavity.

12. The manifold having the thermoelectric module built therein as claimed in claim 11, characterized in that the stirring member is rotatable about an axis intersecting any one of the endothermic and exothermic surfaces.

13. The manifold having the thermoelectric module built therein as claimed in claim 11, characterized in that the manifold body has cavities defined respectively between the thermoelectric module and the endothermic surface and between the thermoelectric module and the exothermic surface, with the stirring member provided in each of the cavities, at least one of the stirring members being provided with magnets, a rotation of one of the stirring members being transmitted to the other of the stirring members by means of a magnetic force.

14. The manifold having the thermoelectric module built therein as claimed in claim 3, characterized in that the manifold body covers only one of the exothermic and endothermic surfaces of the thermoelectric module, the other of the exothermic and endothermic surfaces of the thermoelectric module being held in abutment with a heat conductive plate.

* * * * *